US011528968B2

(12) United States Patent
Nields et al.

(10) Patent No.: US 11,528,968 B2
(45) **Date of Patent: *Dec. 20, 2022**

(54) ARTICLE OF MANUFACTURE HAVING ZIPPER SLIDER WITH ATTACHMENT

(71) Applicant: Talon Technologies, Inc., Woodland Hills, CA (US)

(72) Inventors: Thomas B. Nields, Venice, CA (US); Stephen Lee Howard, Mt. Holly, NC (US)

(73) Assignee: Talon Technologies, Inc., Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/376,275

(22) Filed: Jul. 15, 2021

(65) Prior Publication Data

US 2022/0000223 A1 Jan. 6, 2022

Related U.S. Application Data

(63) Continuation of application No. 16/698,774, filed on Nov. 27, 2019, now Pat. No. 11,064,773, which is a continuation of application No. 16/255,748, filed on Jan. 23, 2019, now Pat. No. 10,492,573, which is a continuation of application No. PCT/IB2019/050543, filed on Jan. 23, 2019.

(60) Provisional application No. 62/625,836, filed on Feb. 2, 2018.

(51) Int. Cl.
*A44B 19/26* (2006.01)

(52) U.S. Cl.
CPC ..... *A44B 19/26* (2013.01); *A44B 19/262* (2013.01); *Y10T 24/2588* (2015.01)

(58) Field of Classification Search
CPC . Y10T 24/2588; Y10T 24/2589; A44B 19/26; A44B 19/262
See application file for complete search history.

(56) References Cited

U.S. PATENT DOCUMENTS

| | | | | |
|---|---|---|---|---|
| 336,063 A | | 2/1886 | Palmer | |
| 2,221,759 A | * | 11/1940 | Erard | A44B 19/262 29/10 |
| 2,405,509 A | | 8/1946 | Davis | |
| 2,790,224 A | | 4/1957 | Mercer et al. | |
| 4,829,638 A | | 5/1989 | Ishii | |

(Continued)

FOREIGN PATENT DOCUMENTS

| | | |
|---|---|---|
| CN | 101766374 A | 7/2010 |
| CN | 205757630 U | 12/2016 |

(Continued)

OTHER PUBLICATIONS

Canadian Intellectual Property Office (CIPO), Office Action in Canadian Patent Application No. 3,089,408, Aug. 31, 2021 [3 pgs ].

PCT Collaborative Search and Examination, Peer ISA, for PCT/IB2019/050543, Japan Patent Office (JPO), dated Jun. 17, earn 17 pgs.].

(Continued)

*Primary Examiner* — Robert Sandy
(74) *Attorney, Agent, or Firm* — Siritzky Law, PLLC

(57) ABSTRACT

An article of manufacture having a zipper assembly with a slider apparatus, the slider apparatus configured with an attachment that may add decorative elements to the slider. The attachment may be configured to the slider using a mount that may include an inner opening that may receive the slider.

13 Claims, 27 Drawing Sheets

(56) References Cited

U.S. PATENT DOCUMENTS

| | | | | |
|---|---|---|---|---|
| 5,007,144 | A | 4/1991 | Terada et al. | |
| 5,068,950 | A | 12/1991 | Yuki | |
| 5,175,910 | A | 1/1993 | Mizuno | |
| 5,195,221 | A | 3/1993 | Kanamaru et al. | |
| 5,611,121 | A | 3/1997 | Akeno et al. | |
| 5,729,874 | A | 3/1998 | Mizuno | |
| 5,884,373 | A | 3/1999 | Kawamura | |
| 6,438,806 | B1 | 8/2002 | Lin | |
| 6,523,232 | B2 | 2/2003 | Chen | |
| 7,866,012 | B2 | 1/2011 | Keyaki et al. | |
| 8,122,573 | B2 | 2/2012 | Takazawa | |
| 10,492,573 | B2 | 12/2019 | Howard et al. | |
| 2002/0108218 | A1 | 8/2002 | Chen | |
| 2005/0125968 | A1 | 6/2005 | Yamazaki | |
| 2008/0229555 | A1 | 9/2008 | Keyaki et al. | |
| 2010/0170067 | A1* | 7/2010 | Takazawa ..... | A44B 19/308 24/419 |
| 2015/0237973 | A1 | 8/2015 | Kojima et al. | |
| 2016/0135552 | A1 | 5/2016 | Li et al. | |

FOREIGN PATENT DOCUMENTS

| | | | |
|---|---|---|---|
| CN | 106333431 | A | 1/2017 |
| EP | 0743024 | A2 | 11/1996 |
| EP | 2891425 | A1 | 7/2015 |
| FR | 2248801 | A1 | 5/1975 |
| TW | M569571 | U | 11/2018 |
| TW | M574421 | U | 2/2019 |

OTHER PUBLICATIONS

PCT Collaborative Search and Examination, Peer ISA, for PCT/IB2019/050543, European Patent Office (EPO), dated May 16, 2019(11 pgs.].

PCT Collaborative Search and Examination, Peer ISA, for PCT/IB2019/050543, China National Intellectual Property Administration, dated May 15, 2019 [10 pgs.].

PCT Collaborative Search and Examination, Peer ISA, for PCT/IB2019/050543, United States Patent & Trademark Office (USPTO), dated May 7, 2019 [6 pgs.].

English translation of CN 205757630, Dec. 7, 2016, Hua Sheng Da Zipper Co., Ltd.

English translation of FR 2248801 A1, May 23, 1975, Ailee Fermeture SA.

WIPO, International Search Report for PCT/1B2019/050543, dated Jun. 19, 2019 [3 pgs.].

WIPO, Written Opinion of the International Searching Authority for PCT/1B2019/050543, dated Jun. 19, 2019 (10 pgs.].

Abstract (in English) of CN205757630 U (Hua Sheng Da Zipper Co., Ltd.) Dec. 7, 2016.

Abstract (in English) of FR2248801 A1 (Ailee Fermeture SA) May 23, 1975.

WIPO, International Preliminary Report on Patentability for PCT/1B2019/050543, dated Aug. 4, 2020 [11 pgs.].

Taiwan Intellectual Property Office, Office Action and Search Report in Taiwan Patent Application No. 108103116, dated Mar. 3, 2022 [6 pgs.].

* cited by examiner

ARTICLE OF MANUFACTURE HAVING ZIPPER SLIDER WITH ATTACHMENT

RELATED APPLICATIONS

This application is a continuation of U.S. patent application Ser. No. 16/698,774, filed Nov. 27, 2019, issued Jul. 20, 2021 as U.S. Pat. No. 11,064,773, which is a continuation of U.S. patent application Ser. No. 16/255,748, filed Jan. 23, 2019, issued Dec. 3, 2019 as U.S. Pat. No. 10,492,573, and which claims benefit/priority from U.S. Provisional patent application No. 62/625,836, filed Feb. 2, 2018, the entire contents of each of which are hereby fully incorporated herein by reference for all purposes. U.S. patent application Ser. No. 16/255,748 is also a continuation of PCT application No. PCT/IB2019/050543, filed Jan. 23, 2019, which also claims priority from U.S. Provisional patent application No. 62/625,836, filed Feb. 2, 2018. The entire contents of PCT/IB2019/050543 are also hereby fully incorporated herein by reference for all purposes.

COPYRIGHT STATEMENT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention relates generally to zippers, and, more particularly to a slider to be used with a zipper chain.

BACKGROUND

Zippers have long been used to fasten or otherwise secure items such as jackets, luggage, pockets, and other types of products. A typical zipper may include a slider configured with two face-to-face rows of elements or teeth. The rows of elements are typically connected to a tape or the like, and, as the slider is moved along the tape in one direction, the two rows of teeth may pass though the slider and the teeth may be interlocked resulting in a combined zipper chain. As the slider is moved along the tape in the opposite direction, the rows of teeth separate. In this way, as is well known, an item configured with the zipper may be fastened or unfastened.

Conventional zippers include a puller or tab connected in some way to the slider and that may be grasped to move the slider along the zipper chain or tape. Pullers may be attached to the slider using a loop that may pass through a hole in the slider.

In addition, decorative components or elements may be attached to the puller such that the elements may dangle from the slider. However, by dangling from the slider, these decorative elements may easily become oriented in such a way that they may not be visible or easily recognized.

Also, it is not uncommon for pullers of this sort to break off or otherwise become dislodged from the slider, rendering the slider difficult or impossible to use. And when this happens, any decorative element that may be attached to the puller may also be lost.

Accordingly, it is desirable to provide a customizable slider that can incorporate different decorative components or elements securely.

SUMMARY

The present invention is specified in the claims as well as in the below description. The following summary is exemplary and not limiting. Presently preferred embodiments are particularly specified in the dependent claims and the description of various embodiments.

One general aspect includes a slider apparatus for a zipper or zipper assembly, the slider apparatus including: a slider assembly. The slider apparatus also includes a mount assembly configured and engaged with the slider assembly. The slider apparatus also includes an attachment body attached to the mount assembly with an attachment base.

Implementations may include one or more of the following features, alone or in combination(s):

- The slider apparatus where the attachment body is fixedly attached to the attachment base and where the attachment base is attached to the mount assembly.
- The slider apparatus where the attachment base includes one or more attachment members.
- The slider apparatus where the one or more attachment members engage with corresponding one or more holes in the mount assembly.
- The slider apparatus where the attachment base includes at least two distinct parts.
- The slider apparatus where the at least two distinct parts include a first part attached to the attachment body and a second part engaged with and distinct from said first part, said second part being attached to said mount assembly.
- The slider apparatus where the first part is a base support and where the second part is a base connector, and where the attachment base is formed by the base connector engaging with the base support.
- The slider apparatus where the base support is formed from a harder material than that of the base connector.
- The slider apparatus where the base support is formed of a material including acrylonitrile butadiene styrene (ABS).
- The slider apparatus where the base connector is formed of a material including a polycarbonate.
- The slider apparatus where the at least two distinct parts are comprised of distinct materials.
- The slider apparatus where at least a portion of the attachment base is within a cavity of the attachment body.
- The slider apparatus where the attachment base is glued to the attachment body.
- The slider apparatus where the mount assembly includes an inner opening, and where the slider assembly is configured within the inner opening.
- The slider apparatus where the mount assembly includes a plate, and where at least a portion of the plate is configured within a slot in the slider assembly.
- The slider apparatus where the slot is on the top of the slider assembly and the plate is within an inner opening of the mount assembly.
- The slider apparatus where the slider assembly includes at least one rail, and where the mount assembly includes at least one channel, and where the at least one rail is configured within the at least one channel.
- The slider apparatus where the mount assembly includes at least one opening, and where the attachment base includes at least one attachment member, and where the at least one attachment member is configured within the at least one opening.

The slider apparatus where the at least one attachment member includes at least one post with a corresponding locking tooth.

The slider apparatus where the at least attachment member includes at least one post without a corresponding locking tooth.

The slider apparatus where the at least one attachment member includes at least two posts with corresponding locking teeth.

The slider apparatus where the at least one attachment member includes three or four posts with corresponding locking teeth.

Another general aspect includes a slider apparatus for a zipper chain or zipper assembly, the slider apparatus including: a mount having an inner opening portion. The slider apparatus also includes a slider configured within the inner opening portion of the mount. The slider apparatus also includes an attachment configured with the mount, said attachment including an attachment body.

Implementations may include one or more of the following features, alone or in combination(s):

The slider apparatus further including a plate on the mount, where at least a portion of the plate is configured within a slot in the slider.

The slider apparatus where the slot is on a top of the slider and the plate is within the inner opening portion.

The slider apparatus further including at least one rail on the slider and at least one channel on the mount, where the at least one rail on the slider is configured within the at least one channel on the mount.

The slider apparatus, where the mount includes at least one opening, and where the attachment has at least one attachment member, and where the at least one attachment member is configured within the at least one opening of the mount.

The slider apparatus where the at least one attachment member includes at least one post with a corresponding locking tooth.

The slider apparatus where the at least one attachment member includes at least two posts with corresponding locking teeth.

The slider apparatus where the at least one attachment member includes three or four posts with corresponding locking teeth.

The slider apparatus, where the attachment includes the attachment body attached to an attachment base.

The slider apparatus where the attachment base includes at least two distinct parts.

The slider apparatus where the at least two distinct parts include a first part attached to the attachment body and a second part engaged with and distinct from said first part, the second part being attached to said mount.

The slider apparatus where the first part is a base support and where the second part is a base connector, and where the attachment base is formed by the base connector engaging with the base support.

The slider apparatus where the base support is formed from a harder material than that of the base connector.

The slider apparatus where the attachment body is of a form selected from: a logo (such as a company or team logo), a character (such as a cartoon character or a movie or television character), an emblem (such as a sports emblem), a name (e.g., the letters spelling out the name), accessory (e.g., a jewel or jeweled button), an emoji, a toy, or a generic item (such as a car, a heart, a shoe, an animal, etc.).

The slider apparatus where the base support is formed of a material including acrylonitrile butadiene styrene (ABS).

The slider apparatus where the base connector is formed of a material including a polycarbonate.

Another general aspect includes a slider apparatus for a zipper chain or zipper assembly, the slider apparatus including: a mount with an inner opening and at least one outer opening. The slider apparatus also includes a slider configured within the inner opening. The slider apparatus also includes an attachment including an attachment body and an attachment base having at least one attachment member. The slider apparatus also includes where the at least one attachment member is configured with the at least one outer opening.

Implementations may include one or more of the following features, alone or in combination(s):

The slider apparatus further including a plate within the inner opening of the mount, where at least a portion of the plate is configured within a slot on the top of the slider.

The slider apparatus further including at least one rail on the slider and at least one channel on the mount, where the at least one rail is configured within the at least one channel.

The slider apparatus where the at least one attachment member includes at least one post with a locking tooth.

The slider apparatus where the at least one attachment member includes at least two posts with corresponding locking teeth.

The slider apparatus where the at least one attachment member includes three or four posts with corresponding locking teeth.

The slider apparatus where the attachment body is of a form selected from: a logo (such as a company or team logo), a character (such as a cartoon character or a movie or television character), an emblem (such as a sports emblem), a name (e.g., the letters spelling out the name), an accessory (e.g., a jewel or jeweled button), an emoji, a toy, or a generic item (such as a car, a heart, a shoe, an animal, etc.).

Yet another general aspect includes a zipper assembly including a slider apparatus according to any of previous aspects.

Yet another general aspect includes a product including a zipper assembly with a slider apparatus according to any of previous aspects. The product may be, e.g., a garment, clothing, footwear (shoes, boots, etc.), an item of luggage, or a sports item. Non-limiting examples of products include, without limitation, bags, pencil cases, backpacks, computer/laptop cases, luggage, zip up portfolio case, zip up storage bins for toys, sleeping bags, tents, children make up/toiletry bags, lunch bags, hats with zipper pockets, toys, toy clothing, etc.

Below is an exemplary list of apparatus aspects. Those will be indicated with a letter "A". Whenever such aspects are referred to, this will be done by referring to "A" aspects.

A1. A slider apparatus for a zipper or zipper assembly, the slider apparatus comprising: a slider assembly; a mount assembly configured and engaged with the slider assembly; and an attachment body attached to the mount assembly with an attachment base.

A2. The slider apparatus of aspect A1, wherein the attachment body is fixedly attached to the attachment base and wherein the attachment base is attached to the mount assembly.

A3. The slider apparatus of aspects A1 or A2, wherein the attachment base comprises one or more attachment members.

A4. The slider apparatus of aspect A3, wherein the one or more attachment members engage with corresponding one or more holes or slots in the mount assembly.

A5. The slider apparatus of any one of aspects A1 to A4, wherein the attachment base comprises at least two distinct parts.

A6. The slider apparatus of aspect A5, wherein the at least two distinct parts include a first part attached to the attachment body and a second part engaged with and distinct from said first part, said second part being attached to said mount assembly.

A7. The slider apparatus of aspects A5 to A6, wherein the at least two distinct parts are comprised of distinct materials.

A8. The slider apparatus of aspects A6 to A7, wherein the first part is a base support and wherein the second part is a base connector, and wherein the attachment base is formed by the base connector engaging with the base support.

A9. The slider apparatus of aspect A8, wherein the base support is formed from a harder material than that of the base connector.

A10. The slider apparatus of aspects A8 or A9, wherein the base support is formed of a material comprising acrylonitrile butadiene styrene (ABS).

A11. The slider apparatus of aspects A8 to A10, wherein the base connector is formed of a material comprising a polycarbonate.

A12. The slider apparatus of aspects A1 to A11, wherein at least a portion of the attachment base is within a cavity of the attachment body.

A13. The slider apparatus of aspects A1 to A12, wherein the attachment base is glued to the attachment body.

A14. The slider apparatus of aspects A1 to A13, wherein the mount assembly comprises an inner opening, and wherein the slider assembly is configured within the inner opening.

A15. The slider apparatus of aspects A1 to A14, wherein the mount assembly comprises a plate, and wherein at least a portion of the plate is configured within a slot in the slider assembly.

A16. The slider apparatus of aspect A15, wherein the slot is on the top of the slider assembly and the plate is within an inner opening of the mount assembly.

A17. The slider apparatus of aspects A1 to A16, wherein the slider assembly comprises at least one rail, and wherein the mount assembly comprises at least one channel, and wherein the at least one rail is configured within the at least one channel.

A18. The slider apparatus of aspects A1 to A17, wherein the mount assembly comprises at least one opening, and wherein the attachment base comprises at least one attachment member, and wherein the at least one attachment member is configured within the at least one opening.

A19. The slider apparatus of aspect A18, wherein the at least one attachment member comprises at least one post with a corresponding locking tooth.

A20. The slider apparatus of aspects A18-A19, wherein the at least attachment member comprises at least one post without a corresponding locking tooth.

A21. The slider apparatus of aspects A18-A20, wherein the at least one attachment member comprises at least two posts with corresponding locking teeth.

A22. The slider apparatus of aspects A18 to A21, wherein the at least one attachment member comprises three or four posts with corresponding locking teeth.

A23. A slider apparatus for a zipper chain, the slider apparatus comprising: a mount having an inner opening portion; a slider configured within the inner opening portion of the mount; and an attachment configured with the mount, said attachment including an attachment body.

A24. The slider apparatus of aspect A23, further comprising a plate on the mount, wherein at least a portion of the plate is configured within a slot in the slider.

A25. The slider apparatus of aspects A23-A24, wherein the slot is on a top of the slider and the plate is within the inner opening portion.

A26. The slider apparatus of any one of aspects A23-A25, further comprising at least one rail on the slider and at least one channel on the mount, wherein the at least one rail on the slider is configured within the at least one channel on the mount.

A27. The slider apparatus of any one of aspects A23-A26, wherein the mount comprises at least one opening, and wherein the attachment has at least one attachment member, and wherein the at least one attachment member is configured within the at least one opening of the mount.

A28. The slider apparatus of aspect A27, wherein the at least one attachment member includes at least one post with a corresponding locking tooth.

A29. The slider apparatus of aspects A27-A28, wherein the at least one attachment member comprises at least two posts with corresponding locking teeth.

A30. The slider apparatus of aspects A27-A29, wherein the at least one attachment member comprises three or four posts with corresponding locking teeth.

A31. The slider apparatus of any one of aspects A23-A30, wherein the attachment comprises said attachment body attached to an attachment base.

A32. The slider apparatus of aspect A31, wherein the attachment base comprises at least two distinct parts.

A33. The slider apparatus of aspect A32, wherein the at least two distinct parts include a first part attached to the attachment body and a second part engaged with and distinct from said first part, said second part being attached to said mount.

A34. The slider apparatus of aspects A32-A33 wherein the first part is a base support and wherein the second part is a base connector, and wherein the attachment base is formed by the base connector engaging with the base support.

A35. The slider apparatus of aspect A34, wherein the base support is formed from a harder material than that of the base connector.

A36. The slider apparatus of aspects A34-A35, wherein the base support is formed of a material comprising acrylonitrile butadiene styrene (ABS).

A37. The slider apparatus of aspects A34-A36, wherein the base connector is formed of a material comprising a polycarbonate.

A38. A slider apparatus for a zipper chain, the slider apparatus comprising: a mount with an inner opening and at least one outer opening; a slider configured within the inner opening; and an attachment including an attachment body and an attachment base having at least one attachment member, wherein the at least one attachment member is configured with the at least one outer opening.

A39. The slider apparatus of aspect A38, further comprising a plate within the inner opening of the mount, wherein at least a portion of the plate is configured within a slot on the top of the slider.

A40. The slider apparatus of aspects A38 or A39, further comprising at least one rail on the slider and at least one channel on the mount, wherein the at least one rail is configured within the at least one channel.

A41. The slider apparatus of aspects A38 to A40, wherein the at least one attachment member includes at least one post with a locking tooth.

A42. The slider apparatus of aspects A38 to A41, wherein the at least one attachment member comprises at least two posts with corresponding locking teeth.

A43. The slider apparatus of aspects A38 to A42, wherein the at least one attachment member comprises three or four posts with corresponding locking teeth.

A44. The slider apparatus of one of aspects A1 to A43, wherein the attachment body is of a form selected from one or more of: a logo (such as a company or team logo), a character (such as a cartoon character or a movie or television character), an emblem (such as a sports emblem), a name, an accessory (e.g., a jewel or jeweled button), an emoji, a toy, or a generic item (such as a car, a heart, a shoe, an animal, etc.).

Below are zipper assembly embodiments indicated with a letter "Z".

Z45. A zipper assembly comprising a slider apparatus according to any of aspects A1-A44.

Below are product embodiments indicated with a letter "P".

P46. A product comprising a zipper assembly Z45 with a slider apparatus according to any of aspects A1-A44.

P47. The product of aspect P46, wherein the product is selected from: a garment, footwear, an item of luggage, an item of sports equipment, bags, pencil cases, backpacks, computer/laptop cases, luggage, zip up portfolio case, zip up storage bins for toys, sleeping bags, tents, children make up/toiletry bags, lunch bags, hats with zipper pockets, toys, toy clothing.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PRESENTLY PREFERRED EXEMPLARY EMBODIMENTS

Slider assemblies according to exemplary embodiments hereof are described here.

The following detailed description is not intended to limit the current invention. Alternate embodiments and variations of the subject matter described herein will be apparent to those skilled in the art.

Figure 1:
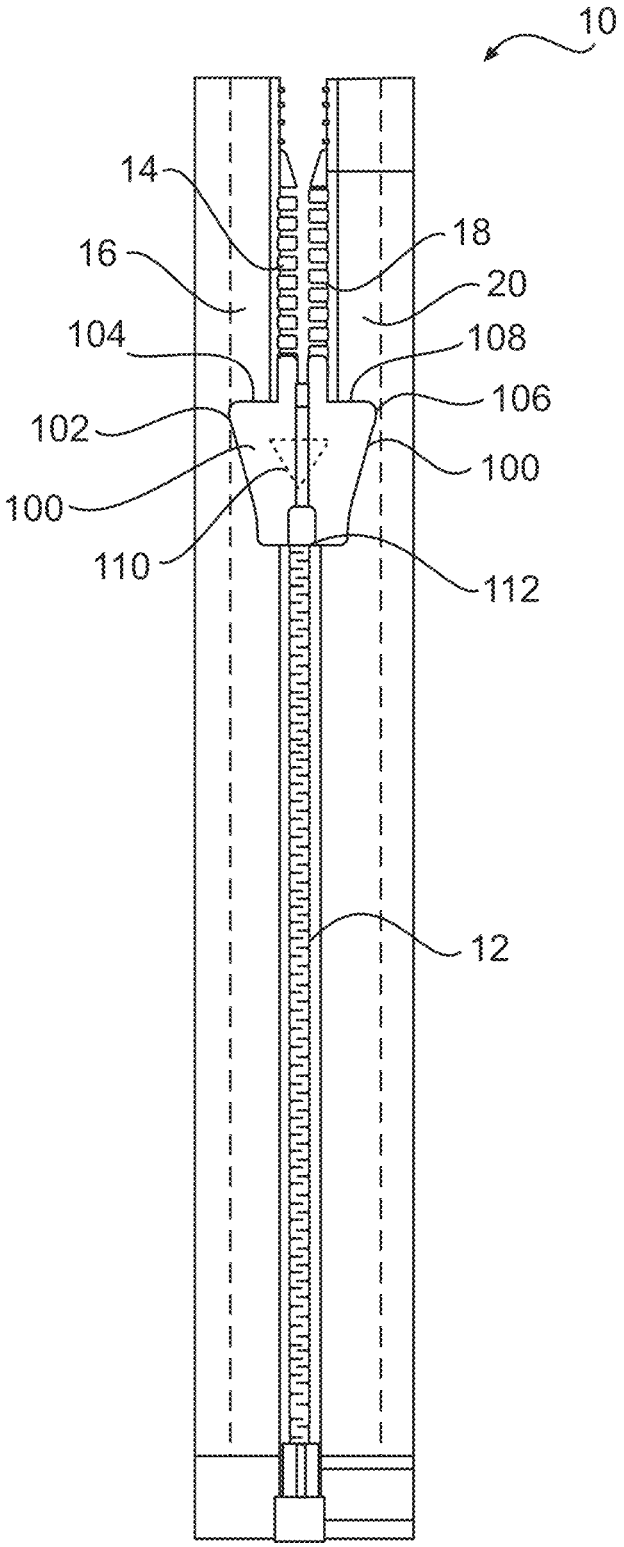
FIG. 1 shows aspects of a slider configured with a zipper chain.

As shown in FIG. 1, and as is well known, a zipper 10 (also referred to as a zipper assembly) includes a zipper chain 12 comprising two individual rows of teeth or elements (left row of teeth 14 attached to left tape 16 and right row of teeth 18 attached to right tape 20) that, when interlocked, may form the combined zipper chain 12. A slider 100 (sometimes referred to as a slider body or slider assembly) may be configured and positioned such that the left row of teeth 14 pass into and through a left side channel 102 in the slider's top left shoulder 104, and right row of teeth 18 pass into and through a right-side channel 106 of the slider's top right shoulder 108. As seen e.g., in FIG. 3E, the left and right side channels 102, 106 may include outer left and right flanges 105, 107, respectively, that may extend inward to generally contain and hold the left row of teeth 14 and the right row of teeth 18 within their respective channels 102, 106. Note that FIGS. 3A-3D and 5A-5E may not specifically show the outer left and right flanges 105, 107, but that it will be appreciated by a person of ordinary skill in the art, upon reading this specification, that the outer left and right flanges 105, 107 of FIG. 3E may be included in the embodiments depicted in FIGS. 3A-3D and 5A-5E even though they may not be depicted.

The left and right side channels 102, 106 may combine below piece 110 within the body cavity of slider 100 (generally hidden from view, and depicted with dashed lines in FIG. 1) to form a mouth 112. The piece 110 may preferably be triangular in shape, diamond shaped, pentagonal shaped, or formed in other types of shapes and may be centered along an axis of the slider 100 in the same direction as the zipper chain 12. In operation, as the left row of teeth 14 and right row of teeth 18 pass through mouth 112, they may interlock to form zipper chain 12.

As is well known, as the slider 100 may be moved from one end of the zipper to the other. As the slider is moved in one direction, the rows of teeth (the left row of teeth 14 and right row of teeth 18) may continue to be interlocked, as they pass through slider 100, to form the length of combined zipper chain 12. In addition, as slider 100 is moved in the other direction, it may contact the joined zipper chain 12 at a junction between left row of teeth 14 and right row of teeth 18 to force them apart, separate them from one another, and generally unlock the two rows of teeth 14, 18. This separation and unlocking may result in two separate and individual rows of teeth 14, 18. This allows zipper chain 12 to be combined to fasten the left and right sides together, and separated to unfasten them. In this way, the zipper 10 may be used as a fastener for jackets, pockets, luggage, and other products.

In addition, some sliders 100 may include an autolocking mechanism that may allow the slider to lock its position anywhere along the zipper chain. In this way, once the positioned by the user, the autolocking slider may lock itself in position such that the zipper may not open unintentionally. This may be very useful for jackets, coats, and such when it is desirable for the slider to remain in position even under duress.

An autolocking slider may include a spring-loaded locking prong that, when activated, may protrude from an opening into the inner body cavity of the slider. The locking prong may be positioned within the slide so that it may physically engage the zipper chain when it may be deployed (e.g., the prong may extend 1-3 mm when deployed). The locking prong may also be retracted back into the opening when it is desired that the slider move freely along the zipper chain to be repositioned.

The extending and/or the retracting of the locking prong may be activated by a mount (also referred to herein as a rail) that may be configured with the slider body. During assembly of the components, the locking prong and the spring may be loaded into the slider body 100, and the mount may then be configured with the slider 100 to secure the components together.

The mount may include a puller, tab, or attachment that may be grasped to move the slider and mount combination along the zipper chain. Alternatively, the mount itself may be grasped directly and moved such that the slider and mount may be positioned on the zipper. Accordingly, it is understood that the mount may preferably act as the element that may be engaged with and generally manipulated by the user, and that the mount in turn may manipulate the slider body along the zipper chain.

The mount may be configured with the slider body such that while generally attached to the slider body (e.g. in channels as will be described in detail below), the mount may move slightly upward and downward relative to the slider, and this motion may engage and disengage the locking pin. Note however, that this motion is controlled within a fixed distance and that the slider body and the mount may not disengage or otherwise come apart when configured.

When the slider and the mount are at rest (i.e. not being moved or positioned along the zipper chain), the mount may generally be held in a centered position with respect to the slider by a preloaded spring. In this position, the locking prong within the slider may generally be extended into the slider's inner body (e.g. by means of the same or different preloaded spring) to engage the zipper chain and lock the slider in place.

When it may be desired to move the slider and mount downward along the zipper chain (e.g. to open the zipper), a downward force may be applied to the mount. As the mount is forced downward, the mount may move into a lower position relative to the slider body, and this motion may retract the locking prong from within the slider. Once the locking pin may be retracted, the mount and slider combination may be moved downward on the zipper chain to be positioned. Then, when the downward force is removed from the mount, the mount may return to a spring loaded centered position with respect to the slider body and the locking prong may extend and lock the slider in place.

When it may be desired to move the slider and mount upward along the zipper chain (e.g. to close the zipper), an upward force may be applied to the mount. As the mount is forced upward, the mount may move into an upper position relative to the slider body, and this motion may retract the locking prong from within the slider. Once the locking pin may be retracted, the mount and slider combination may be moved upward on the zipper chain to be positioned. Then, when the upward force is removed from the mount, the mount may return to a spring loaded centered position with respect to the slider body and the locking prong may extend and lock the slider in place.

In addition, the upper edge of the locking pin may also include an upper angled curvature (or downward slant) such that if an upward force is applied to the mount or slider (e.g. to move the mount and slider upward, thus closing the zipper), the slider may begin to move upward and the zipper chain may ride up onto the angled upper curvature (upper slant) of the locking pin and press the pin downward into a generally retracted position. In this way, as the mount and slider are moved upward, the zipper chain may slide past the locking pin unobstructed. When the upward force is removed, the zipper chain may no longer press the locking pin inward and the locking pin may in turn extend and lock the slider in place. Note that it may be preferable that the lower edge of the locking pin has a more upright curvature (e.g. less of a downward slant) so that this is not possible when the downward force is applied to the slider. As described above, to move the slider and mount downward, the locking pin must be disengaged by the mount.

As described here, an attachment may be configured with a slider (e.g., via a mount or rail mechanism) such that when the mount is engaged with the slider, the combination slider, mount and attachment may be used, effectively as a unit, to move the slider along the zipper chain.

As described below, an attachment may be connected to a mount that then engages with the slider. Preferably an attachment (according to exemplary embodiments hereof) includes an attachment body and an attachment base (described below). The attachment base may be used to connect (preferably fixedly) the attachment body to the mount and thereby to the slider.

An attachment body may be formed to represent any type of shape or combination of shapes, including but not limited to, shapes that may be considered fun and entertaining such as movie/TV and comic book characters, shapes or emblems that may represent different types of sports such as footballs, baseballs, basketballs, soccer balls, baseball bats, hockey sticks, mascots, symbols and other types of sports related shapes or emblems, shapes of animals like lions, tigers, or bears, or any other type of animal or nature shapes. Without limiting the scope hereof, the attachment body may be referred to herein as a character or character attachment. In some non-limiting cases the attachment body may be formed to represent one or more of: a logo (such as a company or team logo), a character (such as a cartoon character or a movie or television character), an emblem (such as a sports emblem), a name, an accessories, an emoji, a toy, or a generic item (such as a car, a heart, a shoe, an animal, etc.). As should be appreciated, the examples of attachment bodies listed here are only for demonstration purposes and do not limit the types of shapes or forms that an attachment body may take.

In some cases, the attachment body may be selected to match the item with which the zipper will be used. For example, a company or team logo may be used as an attachment body with a garment or item that may also include the company or team logo.

Figure 2:
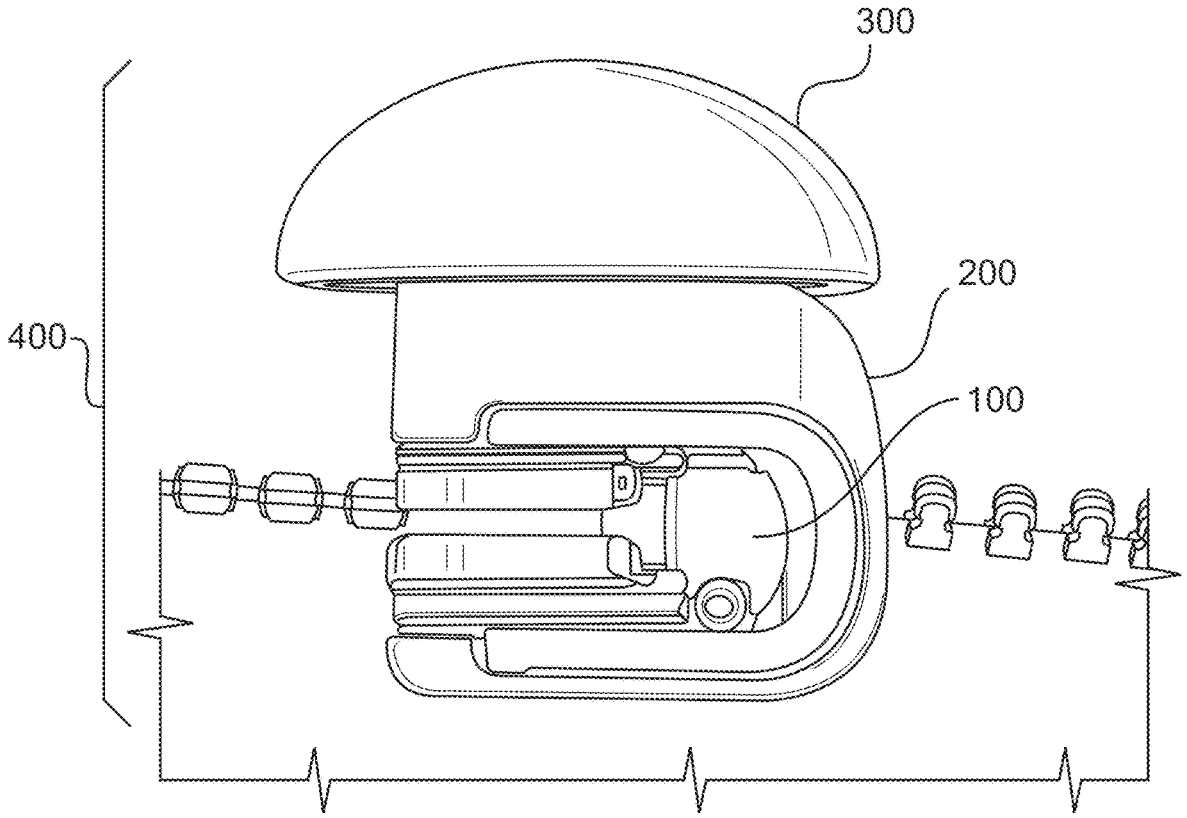
FIG. 2 is a side view of a slider configured with a mount and an attachment according to exemplary embodiments hereof.

The drawing in FIG. 2 shows an exemplary slider apparatus or slider assembly 400 formed with attachment 300 secured (e.g., as described below) to mount 200, with the mount 200 engaged with slider 100. In this example, and in the remaining examples used herein, the attachment 300 includes an attachment body shaped like half a football. As should be appreciated, this exemplary attachment body is used for purposes of explanation, and is not intended to limit the scope hereof in any way.

The Slider

With reference now to FIGS. 3A-3E, a slider 100 (e.g., as shown in FIGS. 1 and 2) may include front plate 114, a back plate 116, and a top head portion 118. The front plate 114 may generally represent the front of the slider 100, the back plate 116 may generally represent the back of slider 100, and the top head portion 118 may generally represent the top of slider 100. The front plate 114 and the back plate 116 may be similar in shape and size, as depicted, although, they may also differ is shape and/or size. The slider 100 may also be referred to as a slider assembly.

Figure 3A:
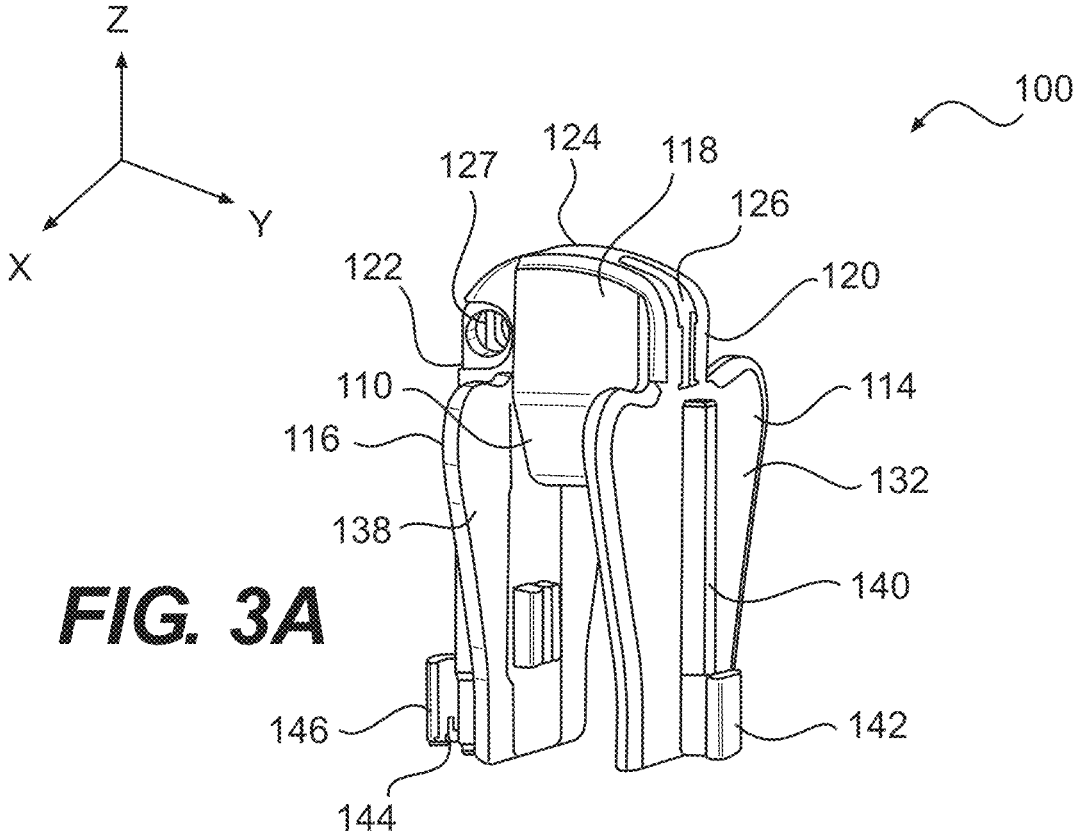
FIGS. 3A-3E depict aspects of a slider according to exemplary embodiments hereof.
Figure 3B:
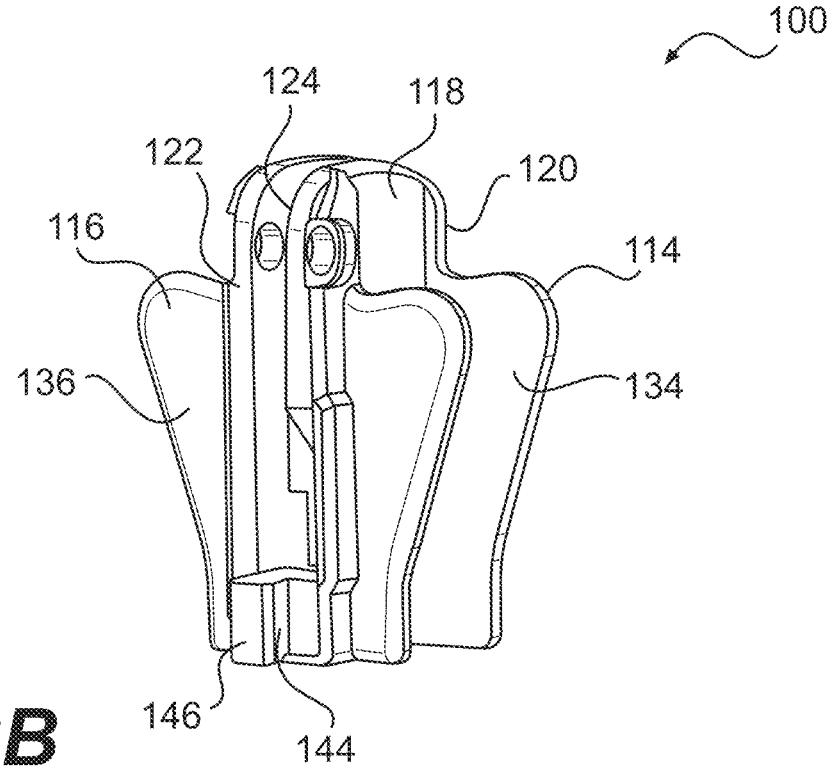
Figure 3C:
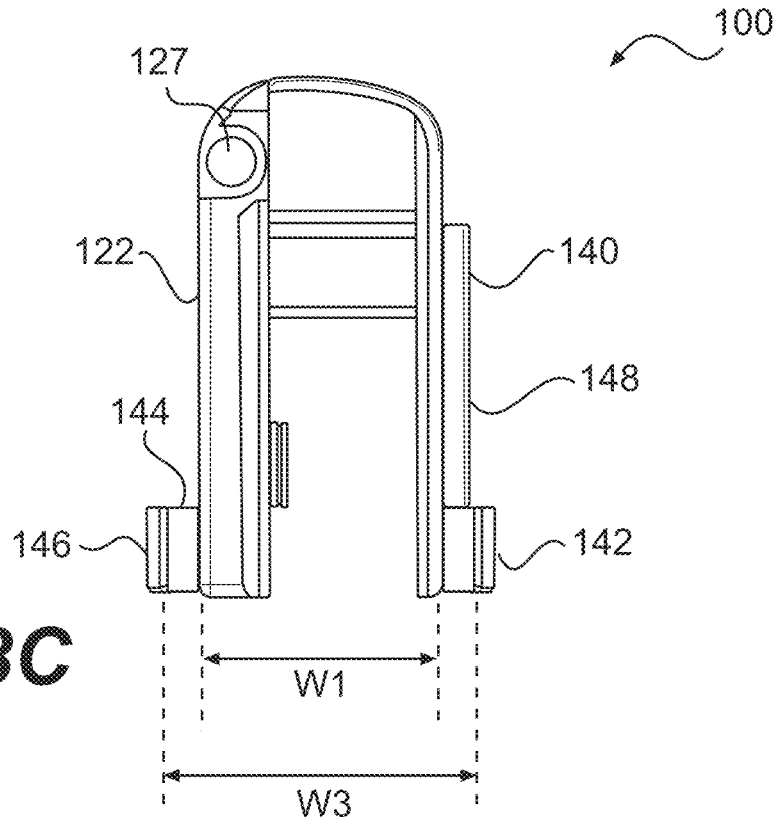

The top head portion 118 may include a front side 120 generally configured with the front plate 114, a back side 122 generally configured with the back plate 116, and a top side 124. The front plate 114 may include an outer surface 132 (FIG. 3A) and an inner surface 134 (FIG. 3B), and back plate 116 may include an outer surface 136 (FIG. 3B) and an inner surface 138 (FIG. 3A). The top head portion 118 may be configured to join the upper portion of the inner surface 134 of front plate 114 with the upper portion of the inner surface 138 of back plate 116. In this way, the top head portion 118 may act as a support structure between front and back plates 114, 116, e.g., as shown in the drawings in FIGS. 3A-3C.

Front plate 114 and back plate 116 may be generally parallel with each other, and may be held in place by top head portion 118. The inner surfaces 134, 138 may thus define a left side channel 102 and a right-side channel 106 within the body of slider 100. In addition, the center piece 110 (FIGS. 1 and 3A) may be configured with the lower portion of top head portion 118 within the body of slider 100.

Figure 3D:
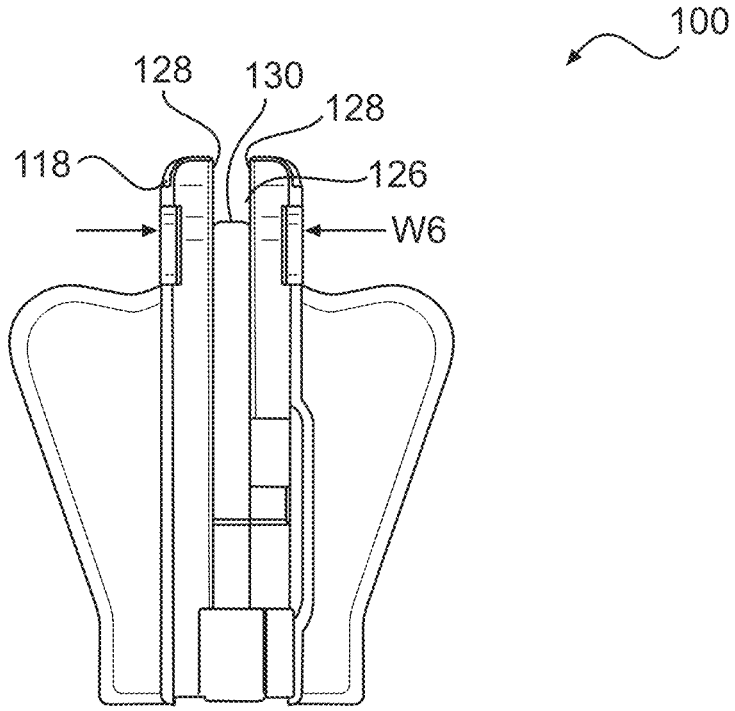
Figure 3E:
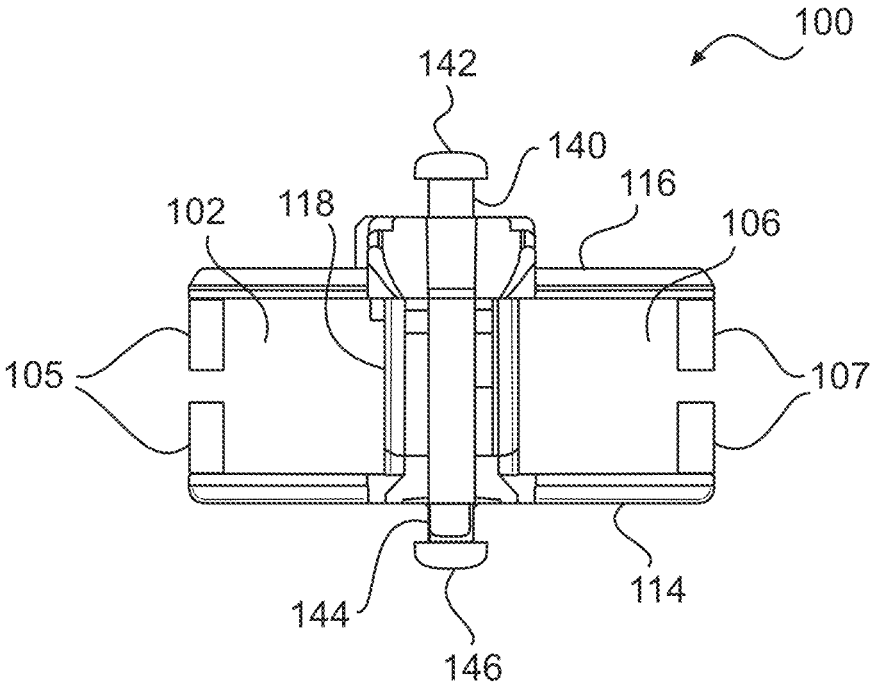

As shown in FIG. 3D, the top head portion 118 may include a circumferential slot 126 that may include side walls 128 and bottom surface 130 and that may generally run from front side 120 to the top side 124 to the back side 122 of the top head portion 118. The slot 126 may be generally located in the center of sides 120, 122, 124, and may generally follow the outer contour of top head portion 118 along the Y-Z plane according to the X-Y-Z axis as shown in FIG. 3A. Note that slot 126 may be continuous or may be made up of individual slot sections that may be generally aligned to form slot 126.

The top head portion 118 may also include hole 127 that may pass through the top 124, rear/back portion 122, or front side 120 of top head portion 118. In the example depicted in the figures, the hole 127 may generally pass through the top 124 rear/back portion 122 portion of top head portion 118. The hole 127 may extend in the direction of the X-axis (shown in FIG. 3A) such that it may pass through slot 126, as shown. The hole 127 may be used for the attachment of a tab or puller to slider 100, or for other functionalities.

The outer surface 132 of the front plate 114 may include a vertical rail 140 that may extend from a top portion to a bottom portion of front plate 114 (FIGS. 3A and 3C). Note however, that vertical rail 140 may extend across any portion of front plate 114, as necessary. The vertical rail 140 may include a lower stub 142 that may be configured with the outer surface of vertical rail 140 towards its bottom portion. The stub 142 may have a width that may be slightly larger than the width of rail 140 such that it may extend slightly over the sides of rail 140.

The back portion 122 of top head portion 118 may extend vertically downward across the outer surface 136 of back plate 116 such that channel or slot 126 may also extend downward over outer surface 136 (FIGS. 3B and 3C). To accommodate this, the outer surface 136 of the back plate 116 may be slightly recessed from this back portion 122 of top head portion 118 and slot 126. In addition, the bottom of the back portion 122 may include vertical rail 144 that may include stub 146 configured on its outer surface. The vertical rail 144 may extend out past the downward extending back portion 122 of top head portion 118 and may include a stub 146 with a width that may be slightly larger than the width of the rail 144, such that it may extend slightly over the sides of rail 144.

With this structure and architecture, and for the purposes of this description, and as depicted in FIG. 3C, the side width W1 of slider 100 may be defined as the distance between the outer front surface 132 of front plate 114 and the outer surface of the back portion 122 of the top head portion 118, extending out from outer surface 136 of back plate 116.

The Mount

A mount 200, according to exemplary embodiments hereof, will now be described with reference to FIGS. 4A-4G. Note that the mount 200 may also be referred to herein as the rail or the mount assembly. The mount 200 may include a mount (or rail) as described above (e.g. configured with the slider to generally activate and deactivate the locking prong) that may be modified such that it may be configured with an attachment. These modifications may include the addition of attachment mechanisms that may be configured to generally accommodate the connection of an attachment.

Figure 4B:
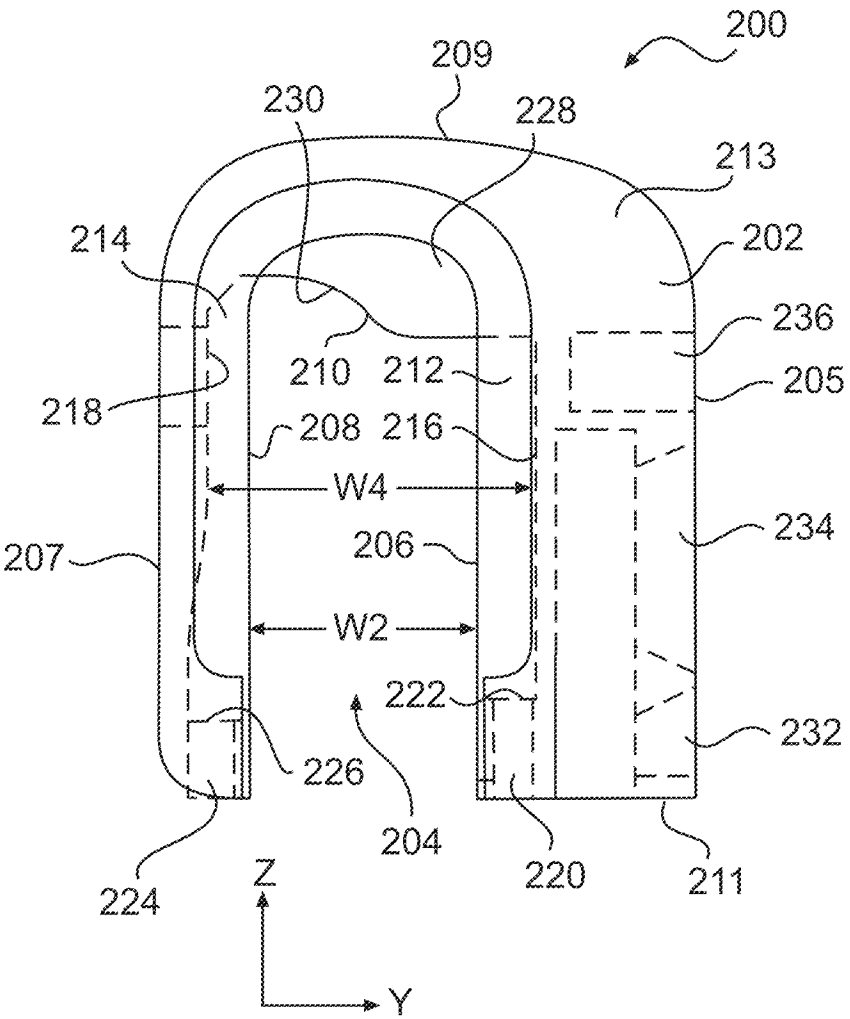
FIGS. 4A-4H depict aspects of a mount according to exemplary embodiments hereof.
Figure 4A:
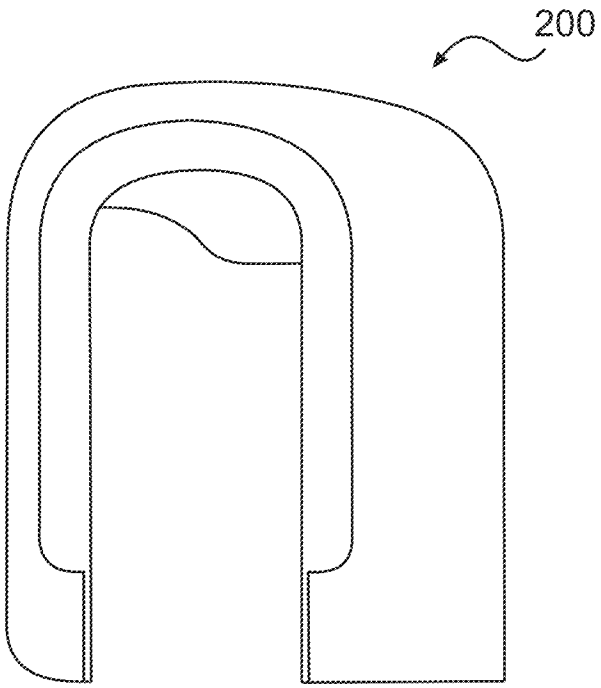
Figure 4C:
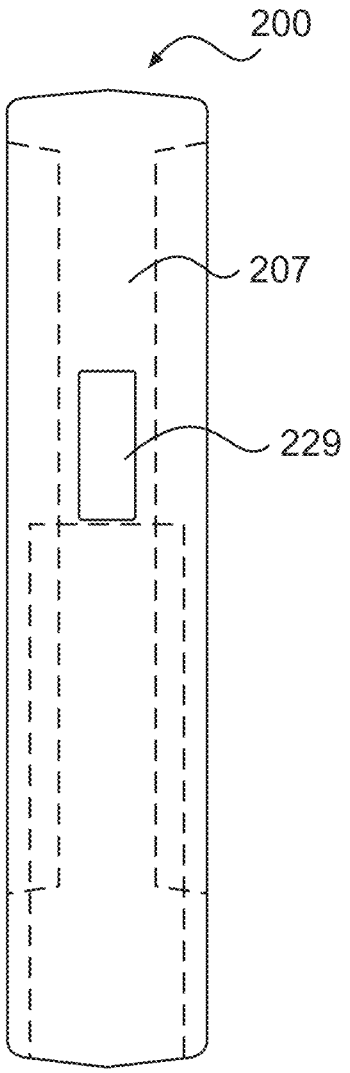
Figure 4D:
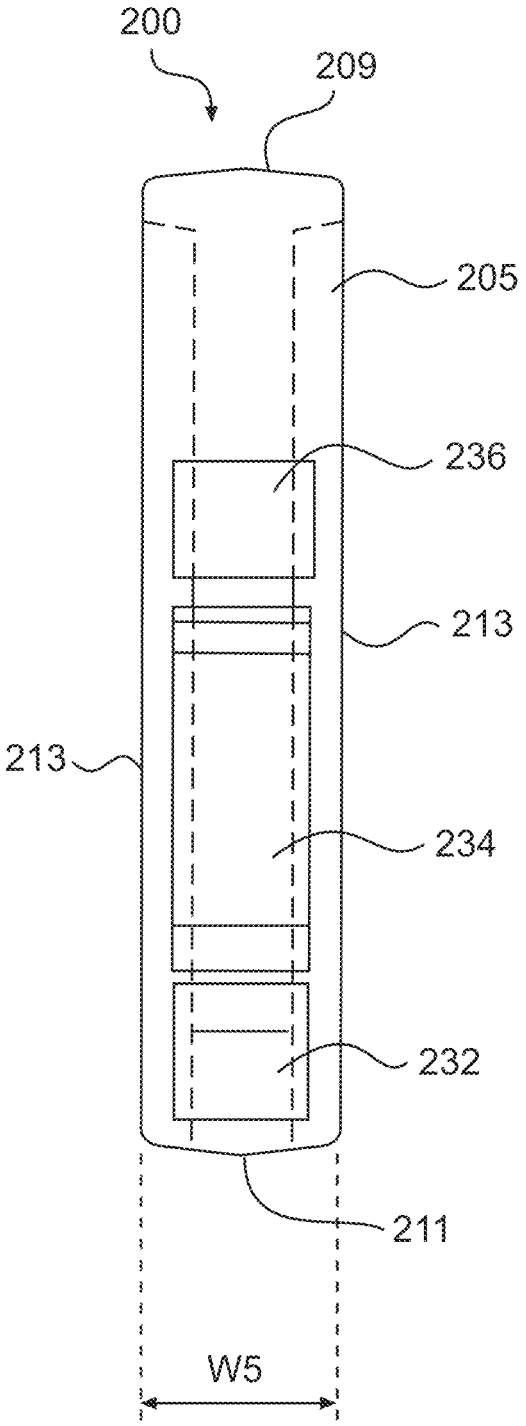

FIG. 4A is a side view showing aspects of a mount 200 according to exemplary embodiments hereof, with FIG. 4B showing the same view as FIG. 4A and including internal details not generally visible and thus depicted with dashed lines in the drawings. FIG. 4C shows back view of mount 200 and FIG. 4D shows a bottom view of mount 200.

Figure 5A:
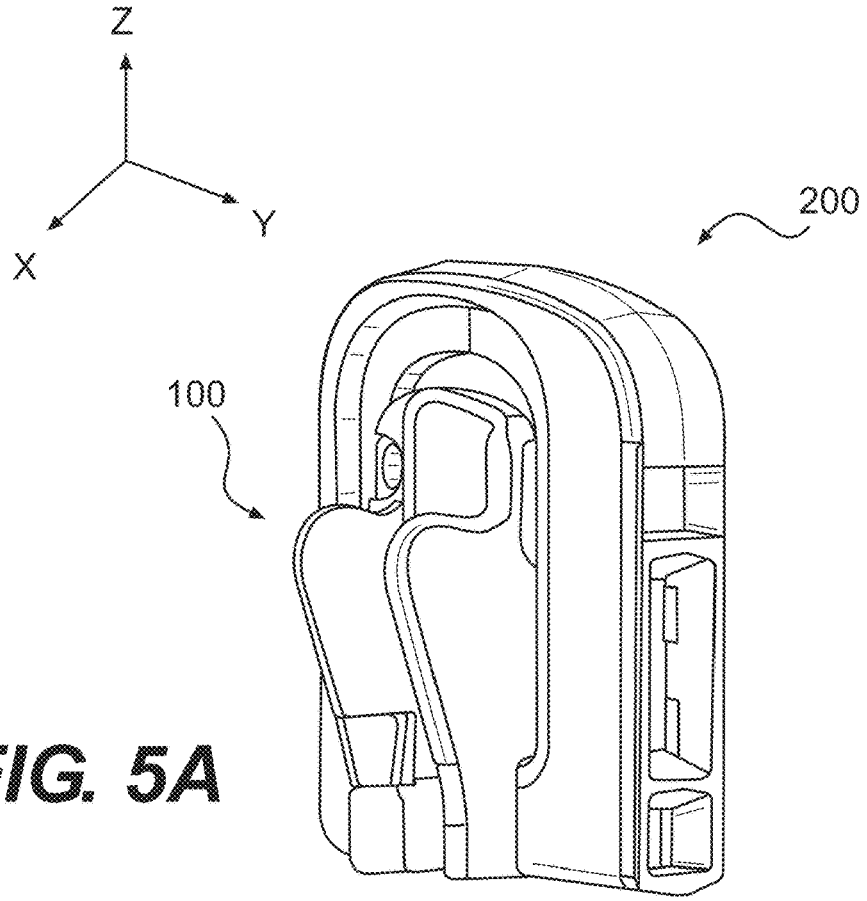
FIGS. 5A-5F are perspective views of a slider configured with a mount according to exemplary embodiments hereof.
Figure 5B:
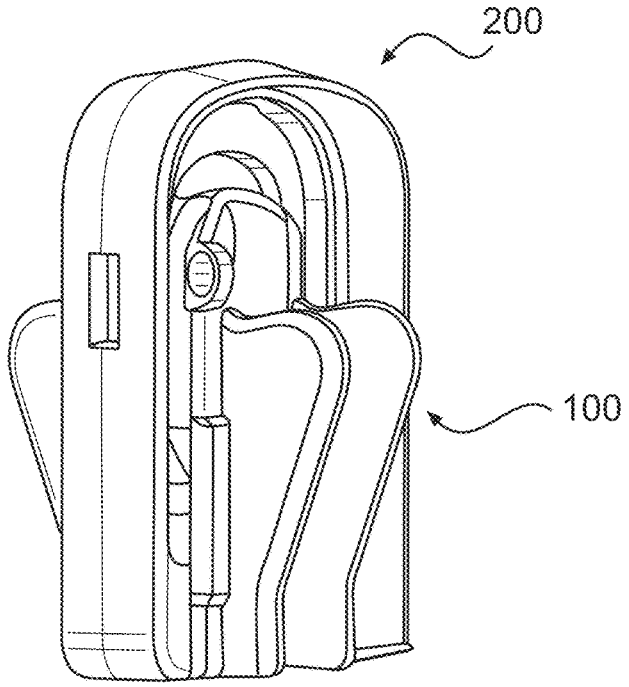
Figure 5C:
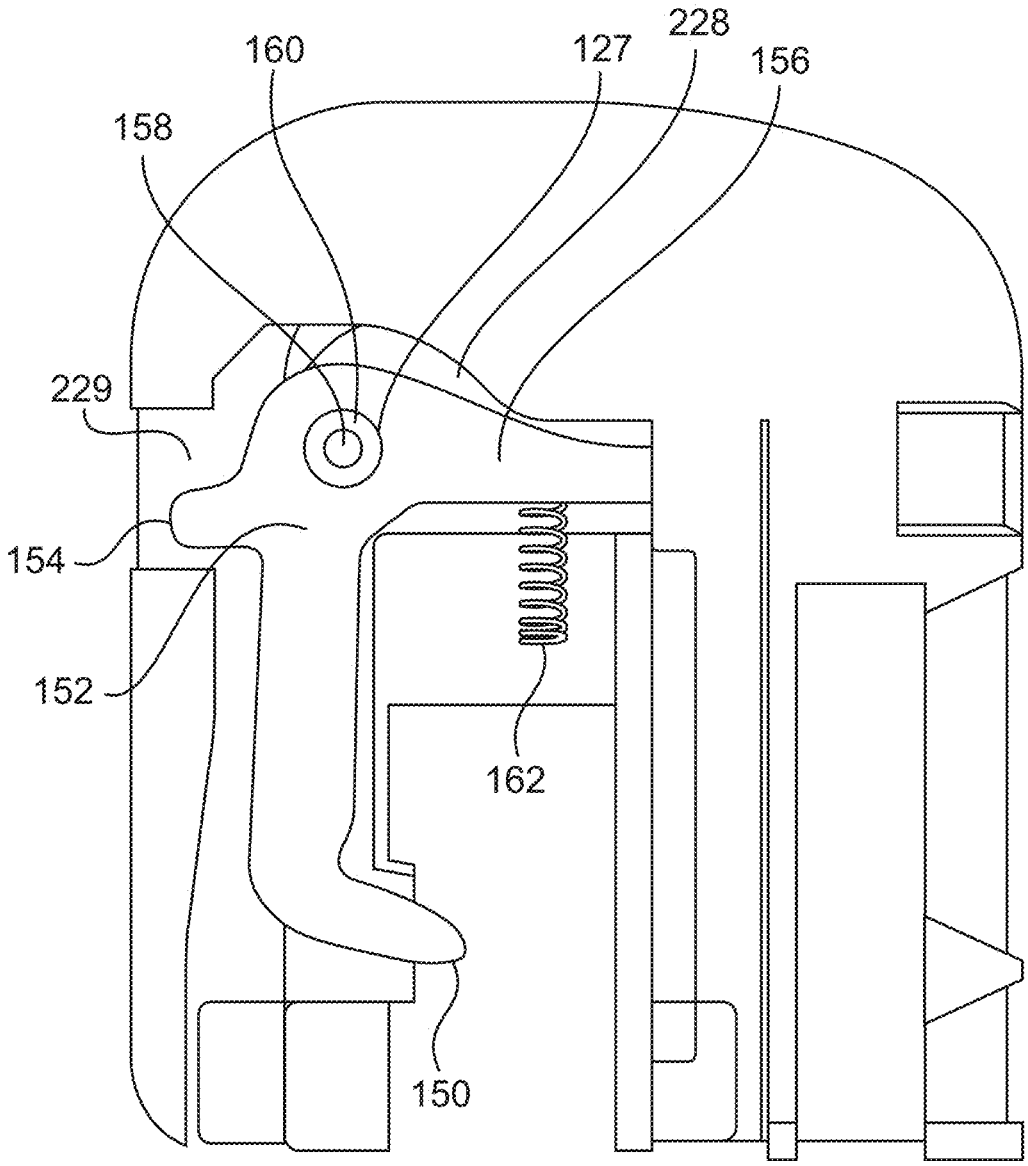

As described above, the mount 200 may be configured with the slider 100 such that the locking prong 150 may be contained within the mount 200/slider 100 combination (as shown in cut-away FIG. 5C). The locking prong 150 may also be configured with an upper rocker arm 152 that may include a left leg 154, a right leg 156 and a pivot point 158 (e.g., the pivot point 158 may be a hole in the rocker arm 152). A tube pin 160 may pass through the hole 127 of the slider and through the pivot point 158 of the rocker arm 152 such that the rocker arm 152 may be held in place with the slider 100. One end of the tube pin 160 may include a flared head that may not pass through the hole 127 in the slider, and once configured as described, the other end of the tube pin 160 may be similarly flared using a punch. In this way, the tube pin 160 may secure the components in place and the rocker arm 152 may pivot about the tube pin 160 and its pivot point 158 in generally clockwise and counter-clockwise directions. It can be seen that this clockwise and counter-clockwise rotation may disengage and engage the locking prong 150 from within the body of the slider 100.

With the slider 100 configured with the mount 200 as described above, it may be preferable for the left leg 154 to generally coincide with the opening 229 such that the left leg 154 may snap into the opening 229 to secure slider 100 with the mount 200. In addition, with the mount 200 in its centered position, and with the left leg 154 configured within the opening 229, it may be preferable for the opening 229 to include a gap above and below the left leg 154. In this way, the left leg 154 may move upward and downward within the gap as necessary as the mount 200 is moved from its centered position to its upper and lower positions. Note that that the lower wall of the opening 229 may act as a stop for the left leg 154 such that the mount 200 may not travel downward past this position. In this way, the lower position of the mount is generally determined by the lower wall of the opening 229.

With the left leg 154 configured within the opening 229 in the mount 200, the right leg 156 may be configured with the spring 162. With the mount 200 generally in its centered position with respect to the slider 100 as shown, the spring 162 may be preloaded such that it may hold the rocker arm 152 in a generally counter-clockwise torqued position. This may position the locking prong 150 in a generally extended position within the body of the slider 100 such that it may engage with the zipper chain 12 and lock the slider in place. The retraction or disengagement of the locking prong 150 will be described in later sections.

During assembly, the locking prong 150, the rocker arm 152 and the spring 162 may be inserted into inner cavities with the slider 100. The mount 200 may then be configured with the slider 100 and the tube pin 160 may be inserted and flared to secure the components together.

Figure 4E:
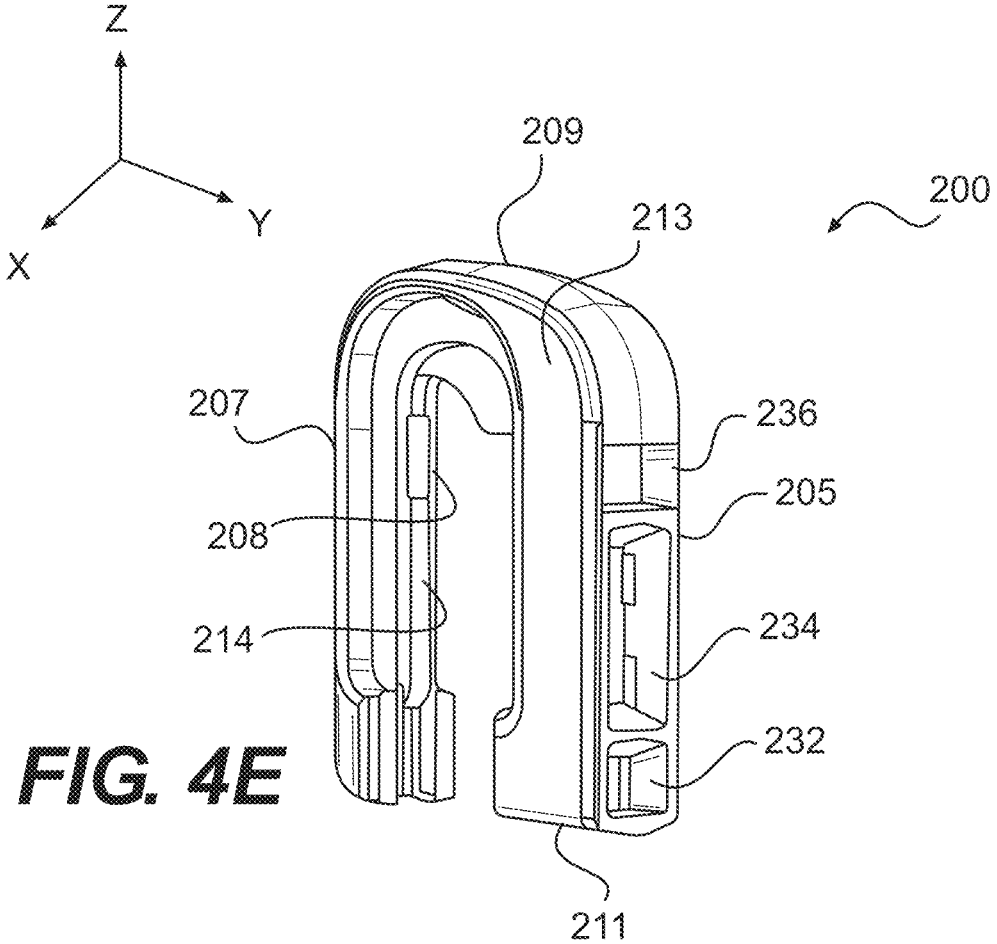
Figure 4F:
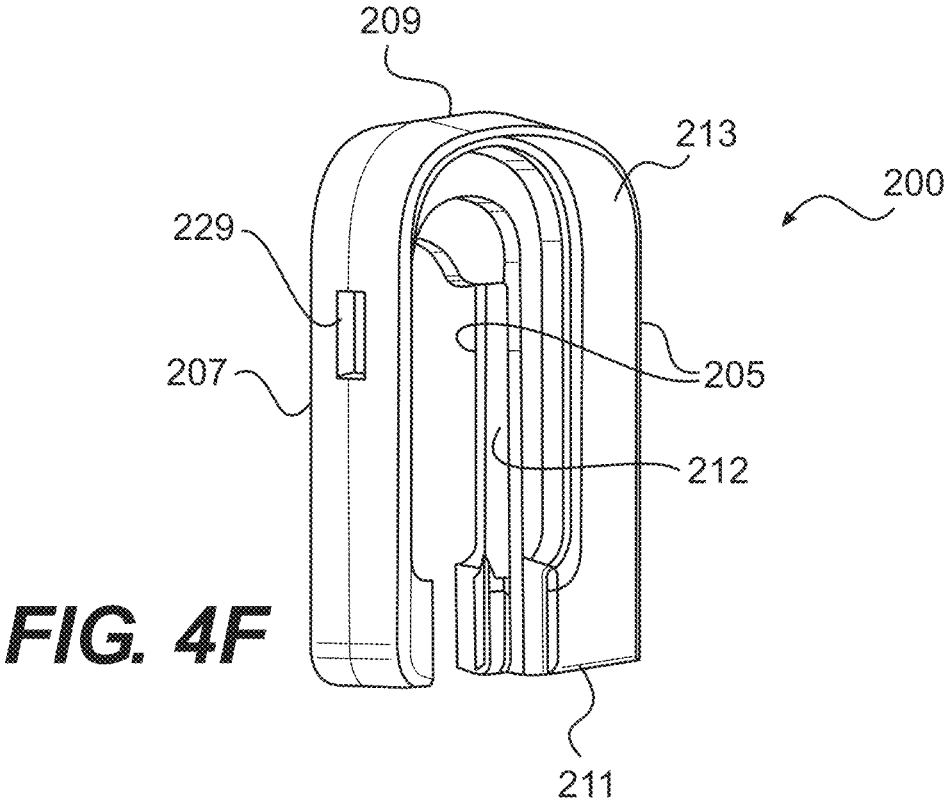
Figure 4G:
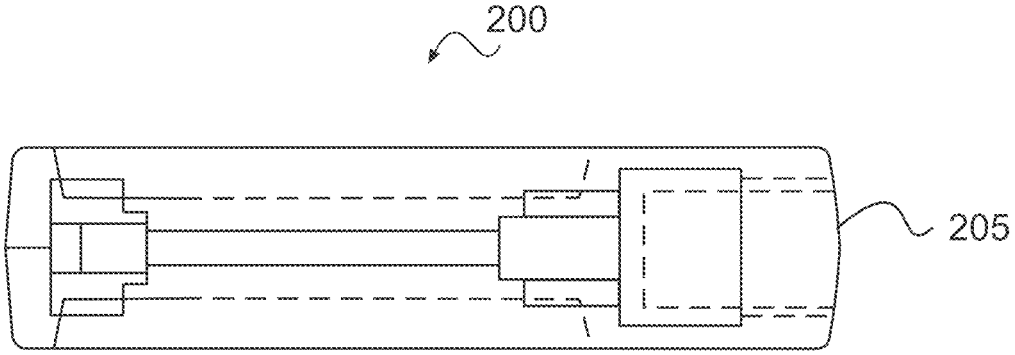
Figure 4H:
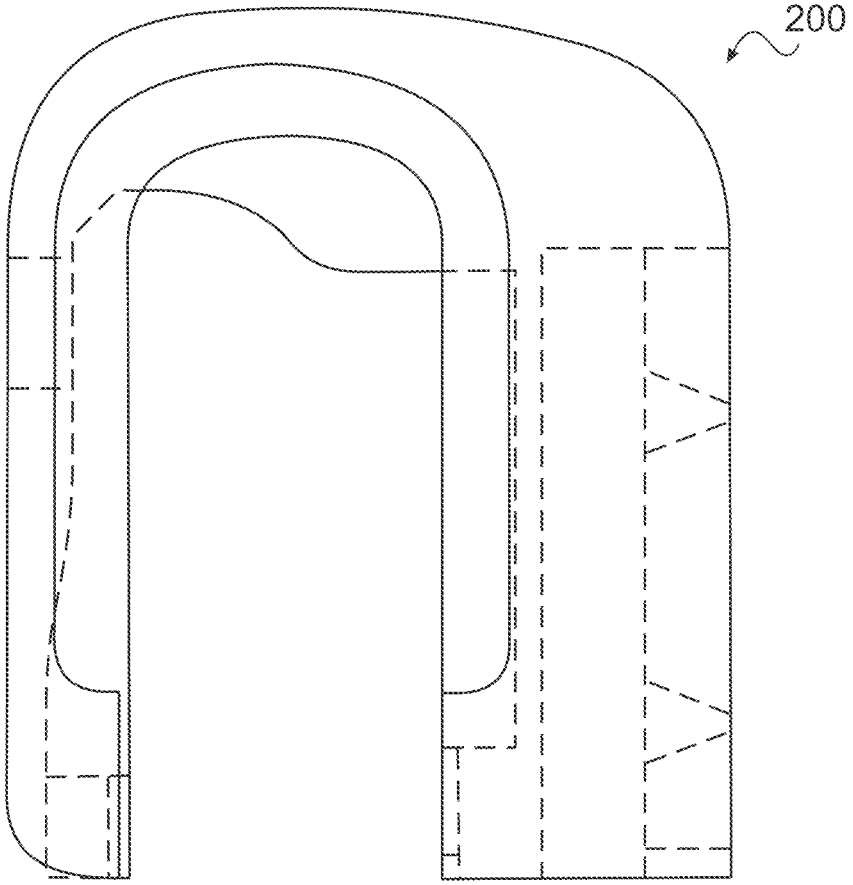

A detailed description of the how the mount 200 may be configured with the slider 100 is provided here. After the locking prong 150, the rocker arm 152 and the spring 162 may be loaded into the body of the slider 100, the mount 200 may be configured to be received by the slot 126, vertical rail 140, and vertical rail 144 of slider 100, to be attached thereto. Accordingly, as shown, e.g., in FIGS. 4B-4G, mount 200 may include a body 202 with lower opening 204. Lower opening 204 may include a front inner side 206, a back inner side 208, and top inner side 210. As used herein, the width W2 of the lower opening may be defined as the distance between front inner side 206 and back inner side 208 (FIG. 4B). The mount 200 may also include a front 205, a back 207, a top 209, a bottom 211, and sides 213 (FIG. 4E).

The front inner side 206 may include an inner vertical channel 212 that may extend from its upper area to its lower area (FIG. 4B). The channel 212 may be generally aligned in the center of front inner side 206. The back inner side 208 may include vertical channel 214 that may extend from its upper area to its lower area (FIG. 4B). Channel 214 may be generally aligned in the center of the back inner side 208.

With reference again to FIG. 3C, the width W3 of slider 100 may be defined as the distance from the outer front surface 148 of vertical rail 140 to a junction between vertical rail 144 and the inner side of stub 146. With reference to FIG. 4B, width W4 within lower opening 204 may be defined as the distance from the inner bottom surface 216 of inner vertical channel 212 to the inner bottom surface 218 of inner vertical channel 214.

FIGS. 5A and 5B show a mount 200 (e.g., as just described) combined or mated with a slider 100.

As depicted in FIGS. 5A and 5B, mount 200 may engage with slider 100 by aligning mount 200 with slider 100 (e.g., along the Y-Z plane according to the X-Y-Z axis shown in FIGS. 3A, 4B, and 5A). Mount 200 may slide onto slider 100 from above such that front vertical rail 140 of slider 100 (FIG. 3C) may engage and be received within inner vertical channel 212 of mount 200. As mount 200 is moved downward into the position on slider 100 (as shown in FIGS. 5A and 5B), a length of front vertical rail 140 may slide within a length of vertical channel 212. It may be preferable that mount 200 have a width W5 (FIG. 4D) that may be equal to or less than width W6 of top head portion 118 of slider 100 (FIG. 3D). In this way, mount 200 may not obstruct the rows of teeth 14, 18 as they enter slider 100 to be interlocked. However, width W5 may also be slightly larger than width W6.

It may be preferable in some exemplary embodiments that the width of channel 212 be just slightly larger than the width of vertical rail 140 such that vertical rail 140 may easily slide within channel 212 but not move freely from side-to-side within channel 212. It may also be preferable in some exemplary embodiments that the depth of vertical channel 212 be sufficient to accommodate the depth of vertical rail 140 such that vertical rail 140 may slide within channel 212 without obstruction. In this way, vertical channel 212 may hold rail 140 secure.

In addition, as mount 200 is moved downward onto slider 100, the back vertical rail 144 of slider 100 may engage and be received within inner vertical channel 214 of mount 200. As mount 200 is moved downward into the position on slider 100 (as shown in FIGS. 5A and 5B), a length of back vertical rail 144 may slide within a length of vertical channel 214.

While FIGS. 3B and 3C depict vertical rail 144 generally extending only the length of stub 146, it may extend upward beyond stub 146.

It may be preferable that the width of channel 214 be just slightly larger than the width of vertical rail 144 such that vertical rail 144 may easily slide within channel 214 but not move freely from side-to-side within channel 214. It may also be preferable that the depth of vertical channel 214 be sufficient to accommodate the depth of vertical rail 144 such that vertical rail 144 may slide within channel 214 without obstructions. In this way, vertical channel 214 may hold rail 144 secure.

The vertical channel 212 may include lower cavity 220 (depicted by dashed lines in FIG. 4B) that may be configured with the bottom of channel 212. Lower cavity 220 of mount 200 may have a width and height that may be chosen to receive stub 142 of slider 100. It may be preferable for stub 142 of slider 100 to be completely received within cavity 220 of mount 200 when mount 200 is fully configured and engaged with slider 100. As stub 142 may have a width that is wider than the width of rail 140, it may be preferable for cavity 220 to have a width wider than rail 140 to accommodate stub 142. In this way, as mount 200 is moved downward into position on slider 100 with rail 140 sliding into channel 212, stub 142 may enter cavity 220.

Figure 5D:
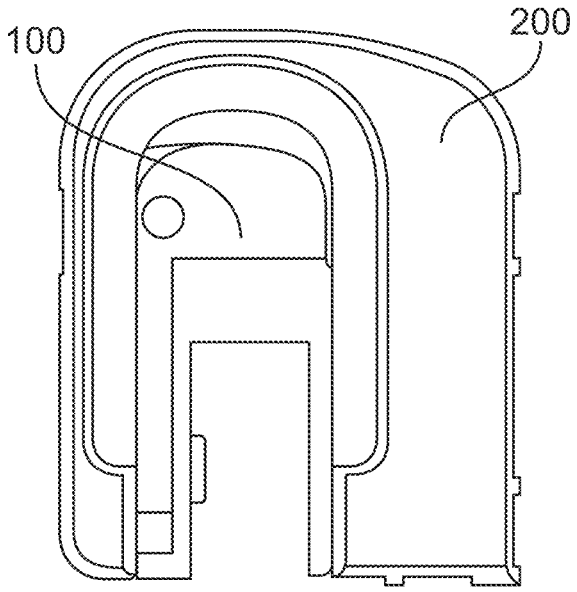
Figure 5E:
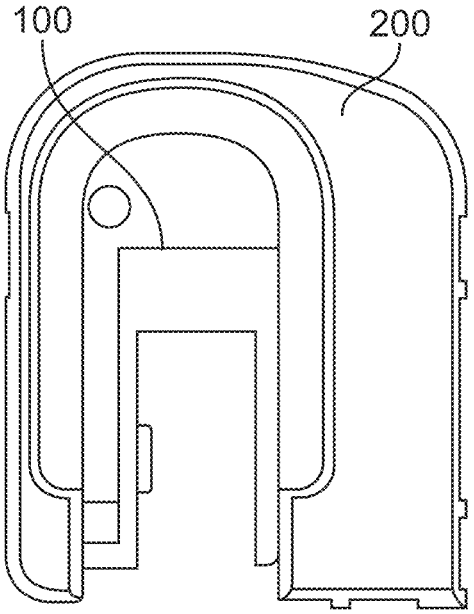

The cavity 220 may include top walls 222 that may extend outward from channel 212 that may provide an upper stop to the top of stub 142. In exemplary embodiments, with the mount 200 configured in its centered position on the slider 100 (as shown in FIG. 5D) such that the locking prong 150 may be deployed (as shown in FIG. 5C), there may exist a gap between the top surface of the stub 142 and the top wall 222 of the cavity 220. In this way, the stub 142 may be able to move upward vertically within the gap and the mount 200 may move into a lower position with respect to the slider 100 as desired (as shown in FIG. 5E).

In addition, and preferably simultaneously, vertical channel 214 may include lower cavity 224 (depicted by dashed lines in FIG. 4B) that may be configured with the bottom of channel 214. Lower cavity 224 may have a width and height that may be chosen to receive stub 146. It may be preferable for stub 146 to be completely received within cavity 224 when mount 200 is fully configured with slider 100. As stub 146 may have a width that is wider than the width of rail 144, it may be preferable for cavity 224 to have a width wider than rail 144 to accommodate stub 146. In this way, as mount 200 is moved downward into position on slider 100 with rail 144 sliding into channel 214, stub 146 may enter cavity 224.

The cavity 224 may include top walls 226 that may extend outward from channel 214 that may provide an upper stop to the top of stub 146. With the mount 200 configured in its centered position on the slider 100 (as shown in FIG. 5D) such that the locking pin/prong 150 may be deployed (as shown in FIG. 5C), there may exist a gap between the top surface of the stub 146 and the top wall 226 of the cavity. In this way, the stub 142 may be able to move upward vertically within the gap and the mount 200 may move into a lower position with respect to the slider 100 as desired (as shown in FIG. 5E).

The top inner side 210 of the lower opening 204 of the mount 200 may include vertical plate 228 that may be configured to fit within slot 126 when mount 200 is fully configured and positioned with slider 100, as described above. Accordingly, plate 228 may have a width that may be slightly less than the width of slot 126 (i.e., the distance between side walls of slot 126) such that it may slide freely into the slot 126. In this way, the plate 228 configured within the slot 126 may act as a guide for the mount 200 as it is moved to its upper, centered and lower positions with respect to the slider 100. It may be preferable in some exemplary embodiments hereof that slot 126 have sufficient depth to fully accommodate and generally receive plate 228 without obstructing the placement of mount 200 in its upper position with respect to the slider 100.

The plate 228 may include a cut-away section 230 that may generally be located on the left portion of the plate 228. With the mount 200 configured and engaged with slider 100 in its upper, centered or lower positions, and with plate 228 of mount 200 received within slot 126 of the slider 100, the cut-away section 230 may ensure that the plate 228 may not obstruct or otherwise interfere with the hole 127 in slider 100 such that the tube pin 160 may not be obstructed.

However, as the mount 200 is placed in its lower position it may also be preferable that the bottom edge of the portion of the plate 228 to the right of the cut-away section 230 may engage with the top of the right leg 156 so that in its lower position (FIG. 5E) the mount 200 may push the right leg 156 downward. This may disengage the locking prong 150 as described below.

With the mount 200 configured with slider 100 as described above, with vertical rails 140, 144 secured within channels 212, 214, respectively, with stubs 142, 146 positioned within cavities 220, 224, respectively, with plate 228 positioned within slot 126 and with the left leg 154 of the pivot/rocker arm 152 configured in the opening 229 (FIG. 4C) of the mount 200, the mount 200 may be secured, attached, and generally configured with slider 100.

As noted, FIGS. 5A-5B show an example of a slider 100 (e.g., as described herein) engaged and configured with a mount 200 (e.g., as described herein).

As should be appreciated, not all of the components of slider 100 and mount 200 described above may be necessary to be used simultaneously and in conjunction at all times, and that slider 100 may be configured and secured with mount 200 by using only some of the described components or in a different manner.

Moving forward, the locking pin/prong 150 may be disengaged (e.g. retracted from within the slider body 100) by an upward and/or downward movement of the mount 200 with respect to the slider 100 (after which the slider may move freely upon the zipper chain 12). As the mount 200 may be moved downward, the lower edge of the plate 228 of the mount 200 within the top slot 126 of the slider 100 may engage with the right leg 154 of the rocker arm 152 and move it downward causing the rocker arm 152 to rotate clockwise about the pivot point 158 and the tube pin 160. This clockwise motion of the rocker arm 152 may defeat the force of the preloaded spring 162 and in turn retract the locking prong 150 from within the slider body 100. In this way, this slight vertical downward movement of the mount 200 into its lower position (shown in FIG. 5E) may retract the locking prong 150 such that the slider 100 may move freely upon the zipper chain 12.

As the mount 200 may be moved upward, the lower wall of the opening 229 may engage with the left leg 154 of the rocker arm 152 and move it upward causing the rocker arm 152 to rotate clockwise about the pivot point 158 and the tube pin 160. This clockwise motion of the rocker arm 152 may defeat the force of the preloaded spring 162 and in turn retract the locking prong 150 from within the slider body 100. In this way, this slight vertical upward movement of the mount 200 into its upper position (shown in FIG. 5F) may retract the locking prong 150 such that the slider 100 may move freely upon the zipper chain 12.

Figure 5F:
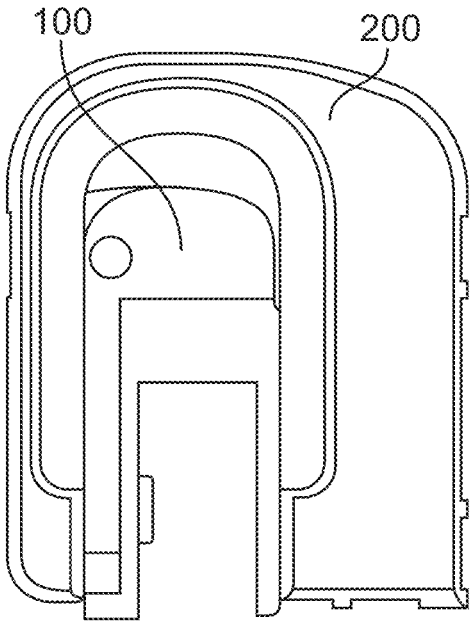

The centered position, the lower position and the upper position of the mount 200 with respect to the slider 100 are depicted in FIGS. 5D, 5E and 5F, respectively. Note however that the positions of the slider 100 within the lower opening 315 of the mount 200 are depicted in FIGS. 5D-5F for demonstration purposes and may be positioned in other areas or locations with respect to the mount, and that these other areas and locations are also within the scope of the slider 100 and mount 200 combination according to exemplary embodiments described herein.

It may also be preferable, in some exemplary embodiments hereof, that the slider 100 be removable from mount 200 as desired by pulling slider 100 away from mount 200, or by pressing the left leg 154 inward within opening 229 to unlock and generally release slider 100 from mount 200.

Attachments and Attachment Bases

As shown, e.g., in FIG. 2, an attachment 300 may be connected to a mount 200, which then engages with a slider 100. Preferably an attachment 300 (according to exemplary embodiments hereof) includes an attachment body and an attachment base. The attachment base may be used to connect (preferably fixedly) the attachment body to the mount 200. As explained, the attachment base may comprise one or more parts, preferably interconnected.

Exemplary embodiments of attachments and attachment bases (for connecting attachment bodies to mounts) are described here.

As noted above, an attachment body may be formed to represent any type of shape, and the descriptions provided here should not limit the types of shapes or forms that attachment 300 may take.

Figure 6A:
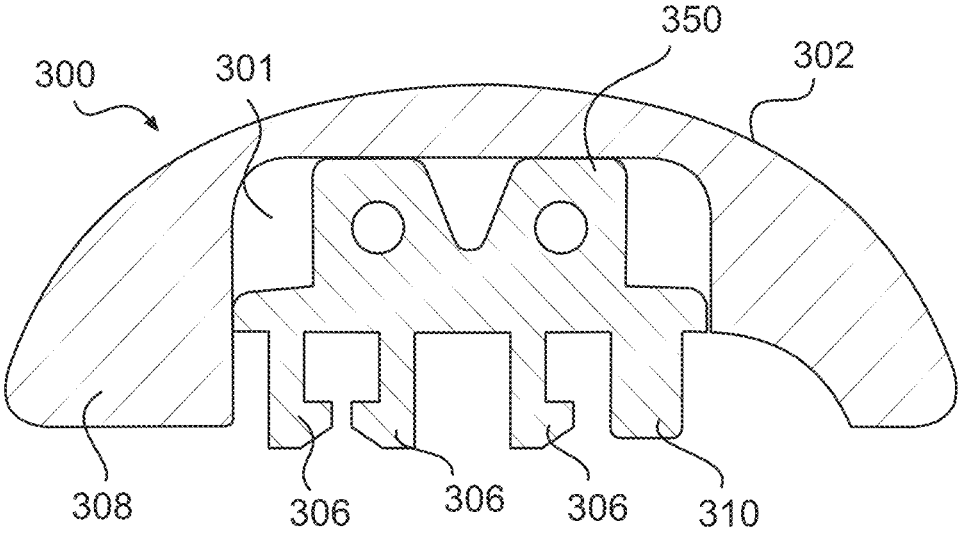
FIGS. 6A-6M depict aspects of bases and supports according to exemplary embodiments hereof.

As depicted, e.g., in FIG. 6A, an exemplary attachment 300 may include an attachment body 302 and an attachment base 304 (also referred to herein as the "base").

The attachment base 304 may be configured and combined with the attachment body 302 and may include one or more securing members 306 that may generally protrude from its bottom to form the lower portion of the attachment base 304. In this way, when the attachment body 302 may be configured with the attachment base 304, the attachment securing members 306 may be used to configure the attachment body 302 (in combination with the attachment base 304) to the mount 200, as will be described in detail below. The securing members may also be referred to herein as attachment members.

In some exemplary embodiments hereof, the attachment body 302 may include a recess or cavity 301 that may be generally located on its bottom 308 (or other area) that may receive at least a portion of the attachment base 304 (e.g., an upper portion of the attachment base 304). The cavity 301 may be a size and shape that may allow the cavity 301 to adequately receive at least a portion of the base 304 such that the base 304 may be adequately secured within the cavity 301. In addition, in some cases, the cavity 301 may be shaped, sized and generally configured to receive a portion of the mount 200 in addition to the base 304 (e.g., when the base 304 may be configured with the mount 200 as described below).

The attachment base 304 may be secured within the cavity 301 using adhesive or other types of attachment methods (alone or in combination) such as pressure fit, clips, snaps and/or other types of attachment mechanisms. The base 304 may also be co-molded, over-molded, co-injection molded, or generally molded in combination with attachment body 302 using other molding techniques to secure the attachment base 304 with the attachment body 302. The attachment base 304 may also be secured to an outer surface of attachment body 302 such as to the bottom, sides, or top of attachment body 302 (using the same or different attachment methods and mechanisms as described above), in which case the cavity 301 may not be necessary or required.

In exemplary embodiments hereof, the attachment base 304 may comprise two parts. A first part, generally referred to herein as an attachment base support 311 (also referred to here as the "base support" or "support"), is used primarily to connect the attachment base 304 to the attachment body 302, whereas a second part, generally referred to herein as an attachment base connector 350 (also referred to here as "base connector"), includes components to connect the base 304 (and thus an attached attachment 300) to a slider. The attachment base 304 may also be referred to herein as the "base," and, especially when the base comprises multiple parts, as the "base combination." Thus, when the base comprises a base support and base connector, the base may be referred to as the "base" and/or as the "base combination."

Figure 6B:
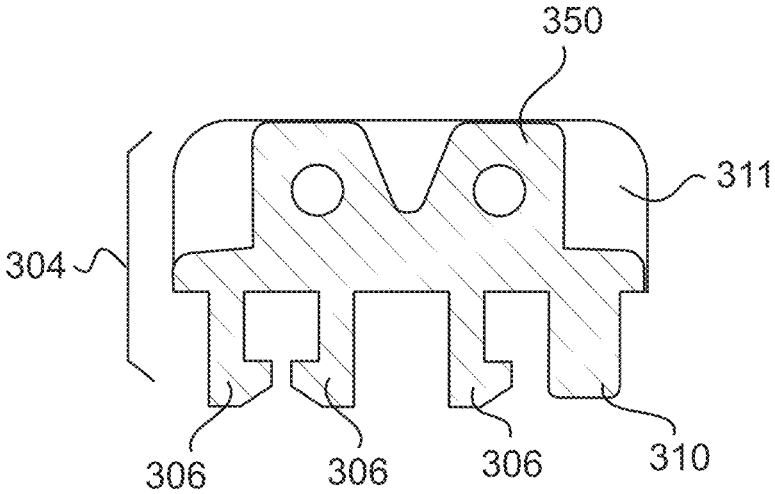

The attachment base support 311 may be generally configured with the attachment base connector 350 to form the base 304, e.g., as depicted in FIG. 6B. The base 304, formed by the combination of the base support 311 and the base connector 350, may then be configured with the attachment body 302 (preferably within the lower cavity 301 of the attachment body 302 as described). In this way, the base support 311 may be or act as an intermediary element generally configured between the base connector 350 and the attachment body 302 to assist in securing, supporting, attaching and generally configuring the base connector 350 (and associated securing members 306) with the attachment body 302.

While the attachment base support 311 and the base connector 350 may be formed of the same material(s), it may be preferable that the attachment base support 311 and the base connector 350 (including the securing members 306) be comprised of different or distinct materials that may include different material properties. In these cases, it may be preferable for the base connector 350 and the attachment base support 311 to each have material properties that may benefit their respective functionalities. For example, it may be preferable that the base support 311 comprises a material that may be hard and rigid so that it may provide a strong foundation for the base connector 350 and the securing members 306 when configured within the recess or cavity 301 of the attachment body 302. For example, the attachment base support 311 may be formed of acrylonitrile butadiene styrene (ABS) and/or other types of materials. On the other hand, it may be preferable that the securing members 306 (of base connector 350) be somewhat flexible such that the securing members 306 may slightly bend and/or flex when being configured and connected to the mount 200 (as described below). For example, the base connector 350 (and thus the securing members 306) may be formed of a polycarbonate and/or other types of materials.

The attachment base 304 may be a single piece or it may be configured with the attachment base support 311 and base connector 350 using co-molding, over-molding, co-injection molding, or other types of molding techniques such that the base connector 350 and the attachment base support 311 may be generally molded together, in sequence or generally in combination and thereby be bonded together by the molding process. Alternatively, the base connector 350 and the attachment base support 311 may be glued together with adhesive, attached using pressure fit, or configured by other attachment methods and/or mechanism(s).

Figure 6C:
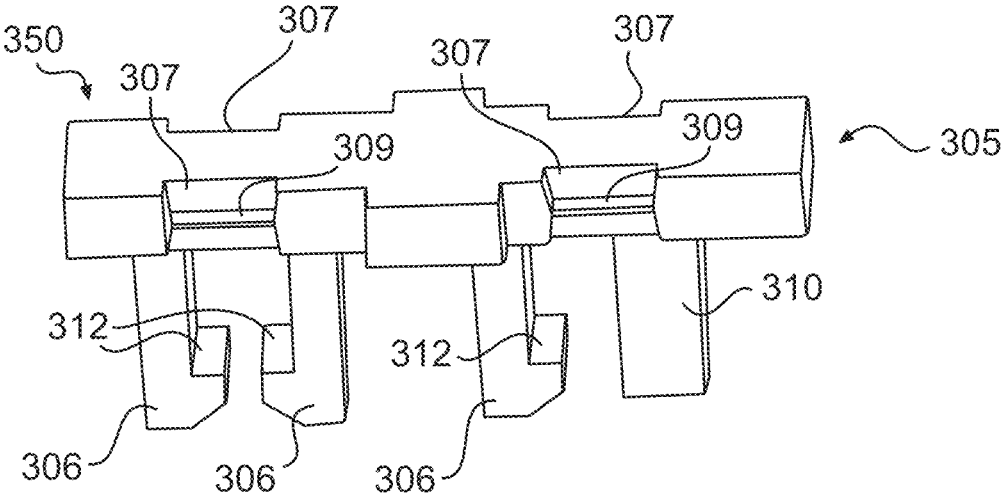
Figure 6D:
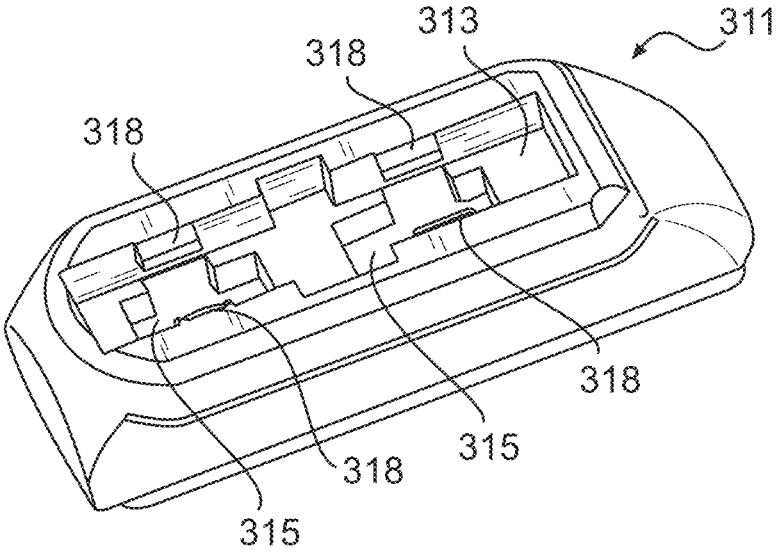
Figure 6E:
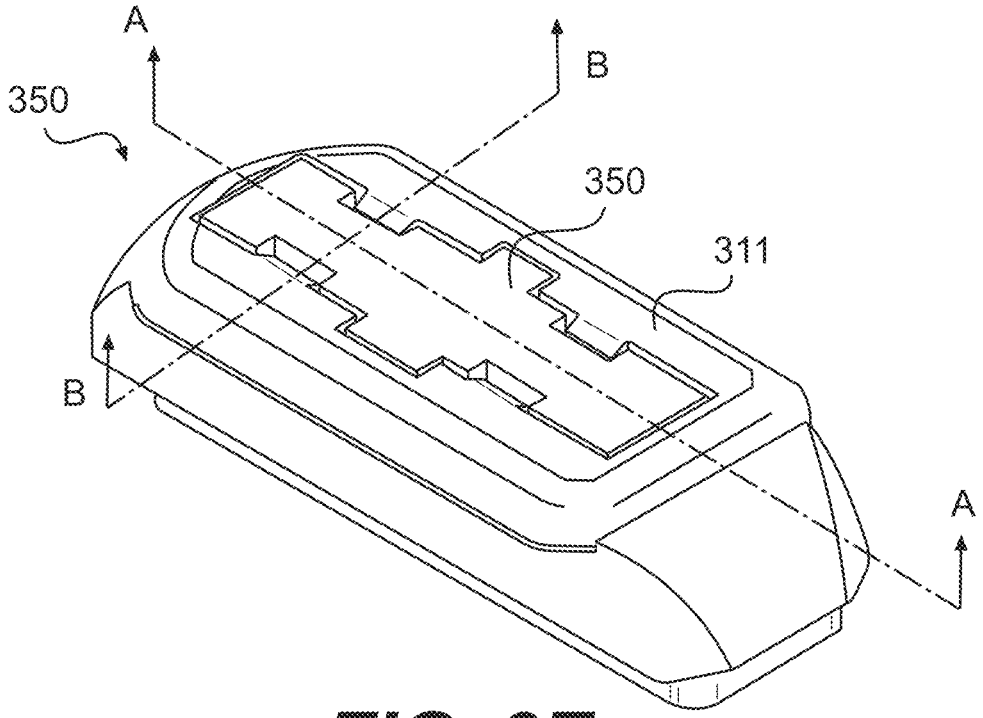
Figure 6F:
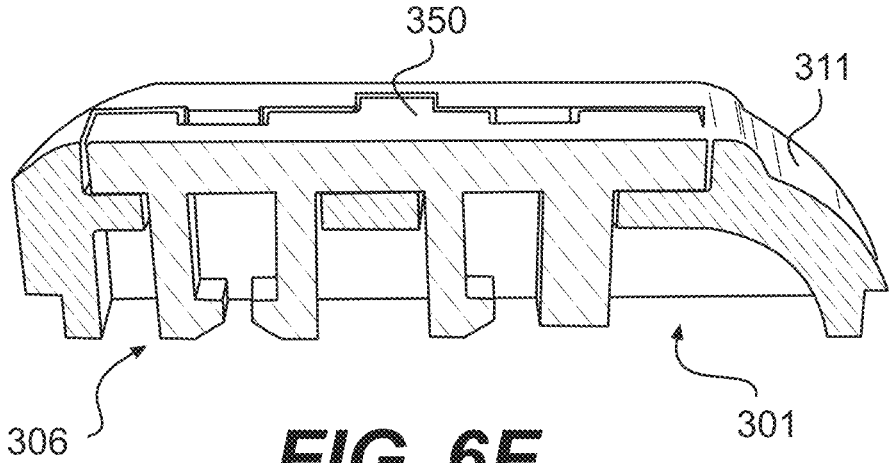
Figure 6G:
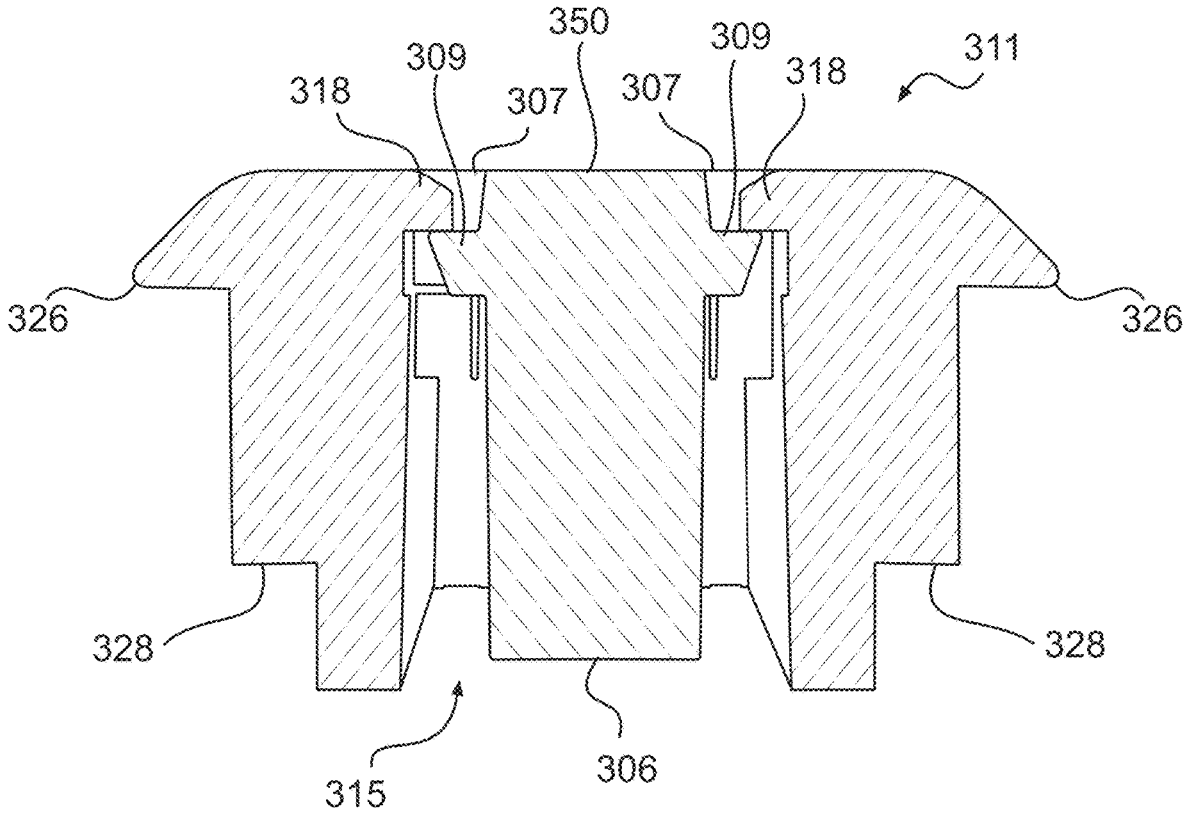
Figure 6H:
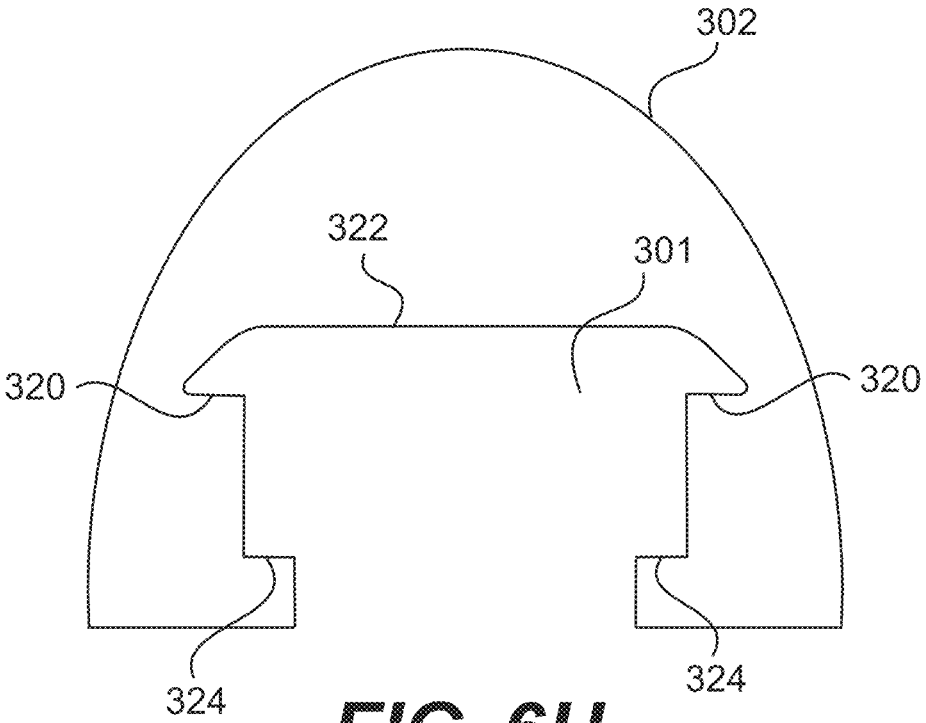

Thus, as noted, in some exemplary embodiments the base 304 may be formed as two separate parts or components (e.g., a base support and a base connector, as shown in FIGS. 6C-6D), and then configured together mechanically (as shown in FIGS. 6E-6G, see also FIGS. 6M-6P). This may reduce the cost of the combined part by eliminating the co-molding process, adhesives and other manufacturing processes, and, as noted above, allows for the use of different materials for the different pieces.

With reference to FIGS. 6C-6D, in some exemplary embodiments hereof, base connector 350 may include an upper portion 305 with a top surface and a bottom surface. The upper portion 305 may generally serve as a platform for the lower securing members 306 such that the securing members 306 may extend from the upper platform 305.

As shown in FIG. 6D the attachment base support 311 may include a top recess 313 that may be generally formed in the top surface of the attachment base support 311. The recess 313 may be formed to receive the upper portion 305 of the base connector 350, and accordingly, may be formed as a similar shape and size so that the upper portion 305 may generally fit within the recess 313 without gaps or disjoints. In this way, once received into the recess 313, the upper portion 305 may have little or no room to move laterally within the recess 313 (FIGS. 6E-6F, see also FIGS. 6M-6P). In the example shown in the figures, the upper portion 305 and the top recess 313 may be generally rectangular in shape (as viewed from the top) with additional side structures (e.g., the rectangular sections on the front and back center areas as depicted), but other shapes and forms may also be used and are in the scope hereof.

With reference again to the drawings in FIGS. 6D and 6F (and 6K), the top recess 313 of attachment base support 311 may also include bottom openings 315 that may generally pass from the recess 313 to out the bottom of the attachment base support 311. The bottom openings 315 may be configured such that the securing members 306 of base connector 350 may pass through the openings 315 as the upper portion 305 of the base connector 350 may be inserted and generally received into the recess 313 of attachment base support 311. In this way, the upper portion 305 may be configured within the recess 313 and the securing members 306 may extend downward through the lower openings 315. Preferably the openings 315 do not block, obstruct or otherwise disallow the securing members 306 from flexing as may be necessary as described in other sections. Accordingly, the openings 315 may include slight gaps between the edges of the openings 315 and the securing members 306 when the securing members 306 may be configured within the openings 315.

The upper portion 305 of the base connector 350 may include side notches 307 that may generally extend downward from the top surface to a location between the top surface and the bottom surface. While FIG. 6C depicts the base connector 350 as having four side notches 307, with two side notches 307 generally located on the front side of the base connector 350 and two side notches 307 generally located on the back side of the base connector 350, the base connector 350 may include any number of side notches 307 that may be located in any positions on the base connector 350. The side notches 307 may each include a lower ridge 309 that may generally define the bottom surface of each side notch 307.

The top recess 313 of attachment base support 311 may include clips 318 that may be configured to be received by the side notches 307 of the base connector 350 when the top or upper portion 305 of the base connector 350 may be inserted into and generally configured with the upper recess 313 of the attachment base support 311. Each clip 318 may be aligned with a corresponding side notch 307 as the base connector 350 may be inserted into the top recess 313. Accordingly, there may be a one-to-one correspondence between the clips 318 and the side notches 307, but this may not be required. The dimensions of the side notches 307 may be chosen so that the clips 318 may be received into the notches 307 without obstructions.

As the base connector 350 is moved downward into the recess 313, the clips 318 and the lower ridges 309 of the side channels or notches 307 may compress and/or flex or bend such that the clips 318 may move past the lower ridges 309. Then, at the point where the clips 318 may pass the ridges 309, the clips 318 and the ridges 309 may return to their uncompressed and/or un-flexed states such that the clips 318 may move over the top surfaces of the ridges 309. In this configuration, the bottom of the clips 318 may abut against the top of the ridges 309 and be held secure thereby. It may be preferable that when in this configuration that there may be no gaps between the bottom of the clips 318 and the tops of the ridges 309 so that the clips 318 may not move vertically or laterally once locked in place.

The depth of the recess 313 may be chosen to coincide with the height of the upper portion 305 of the base connector 350 so that the upper portion 305 may fit within the recess 313 with its top surface generally flush with the top surface of the attachment base support 311. In this way, the combined top surfaces may be free of gaps and disjoints. It may also be preferable that the dimensions of the side notches 307, the clips 318 and the ridges 309 be chosen such that when the base connector 350 is in this position the clips 318 may be configured securely with the ridges 309 as described above. In this way, the base connector 350 may be secured within the recess 313 of the attachment base support 311 as shown in FIGS. 6E-6G. Note that the FIG. 6F is a cross-sectional view of FIG. 6E taken along the cut lines A-A of FIG. 6E, and that FIG. 6G is a cross-sectional view of FIG. 6E taken along the cut lines B-B of FIG. 6E.

As stated above, at least a portion of the base 304 (e.g., the combined base connector 350 and attachment base support 311) may be received and generally configured within the lower cavity 301 of the attachment body 302. The shape and size of the cavity 301 may be chosen to generally coincide with the general shape and size of at least a portion of the base 304 (e.g., the combined base connector 350 and attachment base support 311) such that at least a portion of the combined unit may fit within the recess or lower cavity 301 of the attachment body 302.

In some exemplary embodiments hereof, the cavity 301 may include a top 322, top ledges 320 and lower ledges 324. Also, as shown in FIG. 6G, the attachment base support 311 may include top lips 326 and lower ridges 328. The base 304 (e.g., the combined base connector 350 and attachment base support 311) may be inserted and generally pressed into the cavity 301 from below.

Figure 6I:
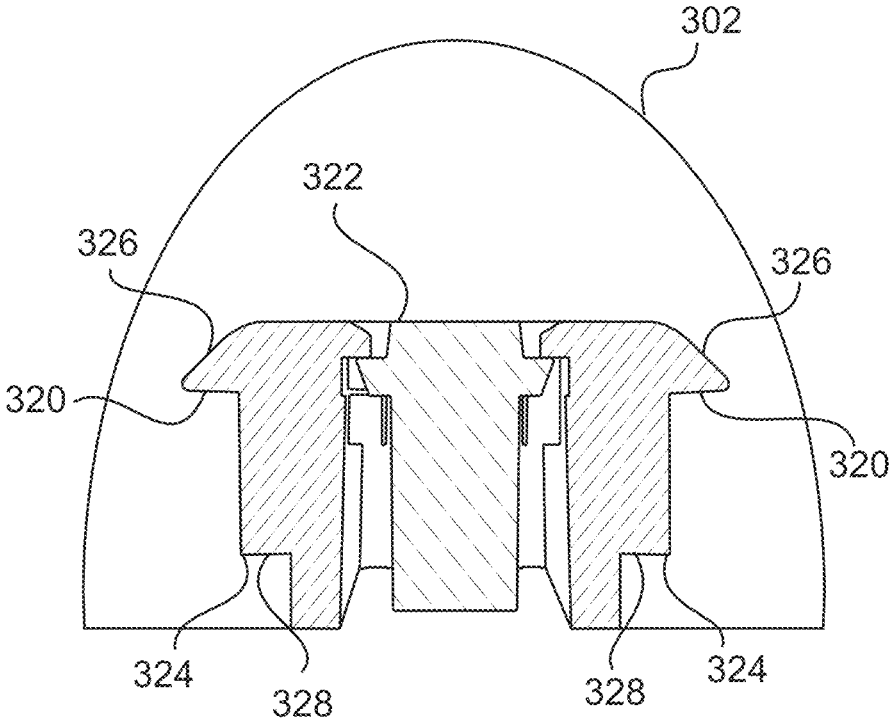
Figure 6J:
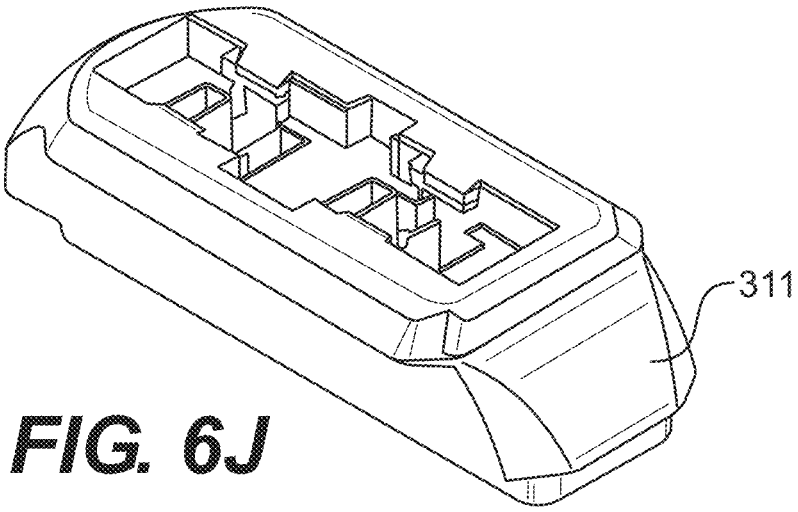
Figure 6K:
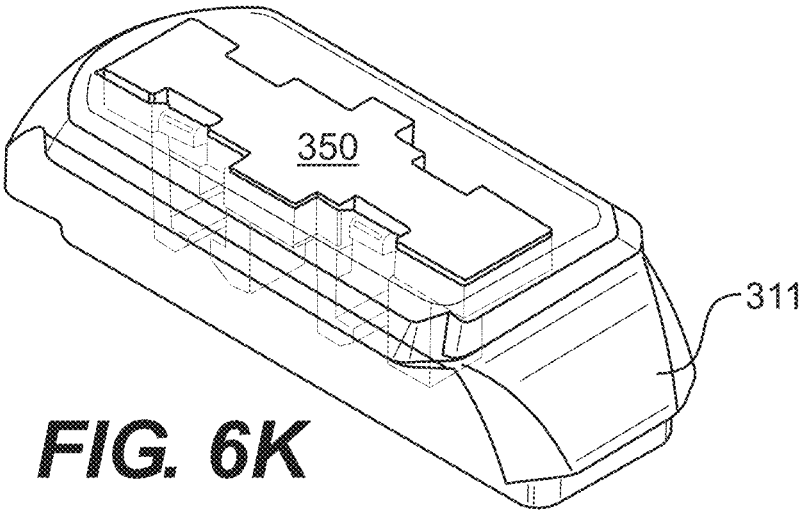
Figure 6L:
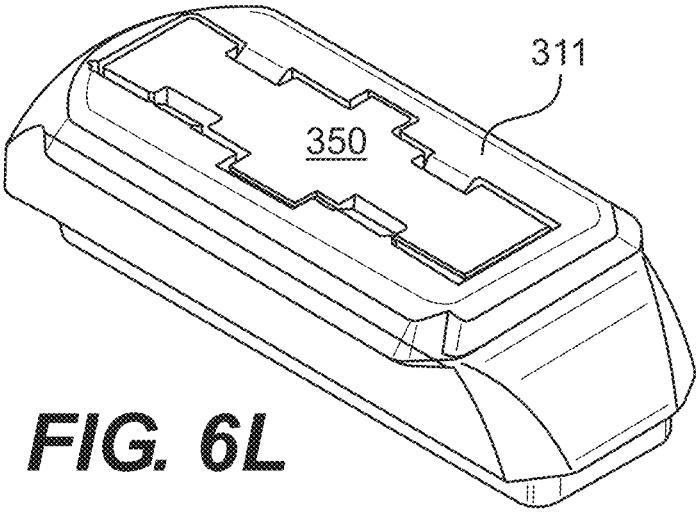
Figure 6M:
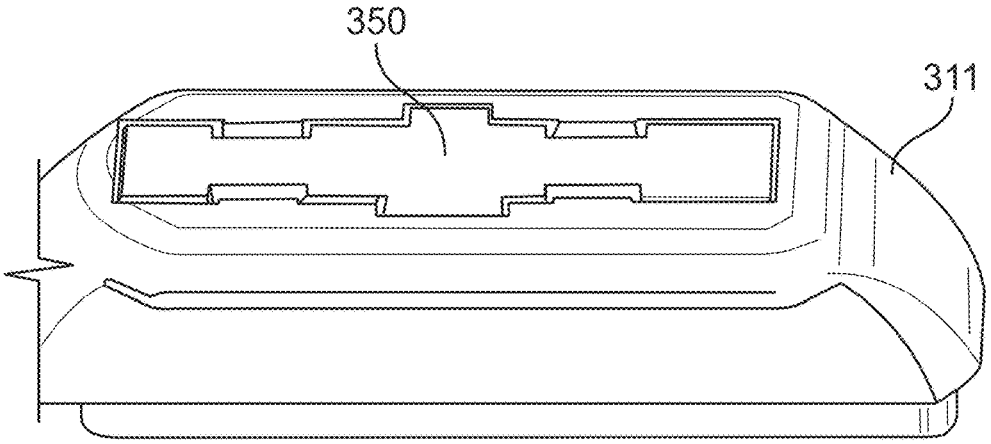

As the base 304 (preferably the combined base connector 350 and attachment base support 311) may be pressed into the cavity 301, the base/support combination may travel into the cavity until the combined top surfaces of the upper portion 305 of the base 304 and the attachment base support 311 may abut against the top 322 of the cavity 301. In this configuration it may be preferable for the top lips 326 of the attachment base support 311 to be generally configured with the top ledges 320 of the cavity 301. Specifically, the lower surfaces of the top lips 326 may abut against the upper surfaces of the ledges 320 and may be held secure thereby. It may also be preferable that in this configuration the lower surfaces of the lower ridges 328 on the attachment base support 311 abut against the upper surfaces of the lower ledges 324 of the cavity 301 and be held secure thereby. As a result of the top lips 326 configured with the top ledges 320, and the lower ridges 328 configured with the lower ledges 324, the combined base 304 and attachment base support 311 may be held securely within the cavity 301. This may result, e.g., in the configuration shown in FIG. 6I.

As the base 304 (preferably the combined base connector 350 and attachment base support 311) is pressed into the cavity 301, the sides (including the lower ledges 324 and the upper ledges 320) may spread, expand, adjust, deform, and/or stretch, as needed, to receive the base 304 (e.g., the combined base connector 350 and attachment base support 311). In this way, the combined base 304 (e.g., the combined base connector 350 and attachment base support 311) may be received into the cavity 301. However, it may be preferable that when the base 304 is configured into the cavity as described above that the sides, lower ledges 324 and upper ledges 320 of the cavity 301 may generally return to their non-expanded and un-stretched states. This may minimize any deformations of the attachment body 302 of the attachment 300 when the base 304 is configured with the recess/cavity 301.

Adhesives or the like may also be added to the cavity 301 and/or the base 304 combination to further secure the base 304 combination within the cavity 301. However, this may not be required.

Figure 7:
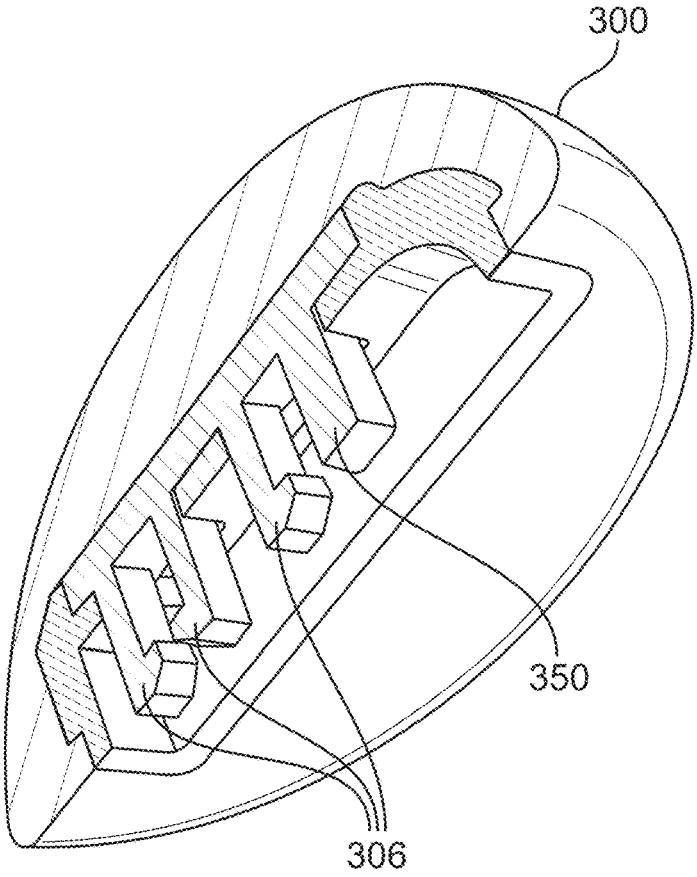
FIG. 7 depicts aspects of an attachment connected to a base according to exemplary embodiments hereof.

FIG. 7 depict aspects of an attachment connected to a base according to exemplary embodiments hereof.

FIGS. 8A-8D depict aspects of slider assemblies according to exemplary embodiments hereof.

Figure 8A:
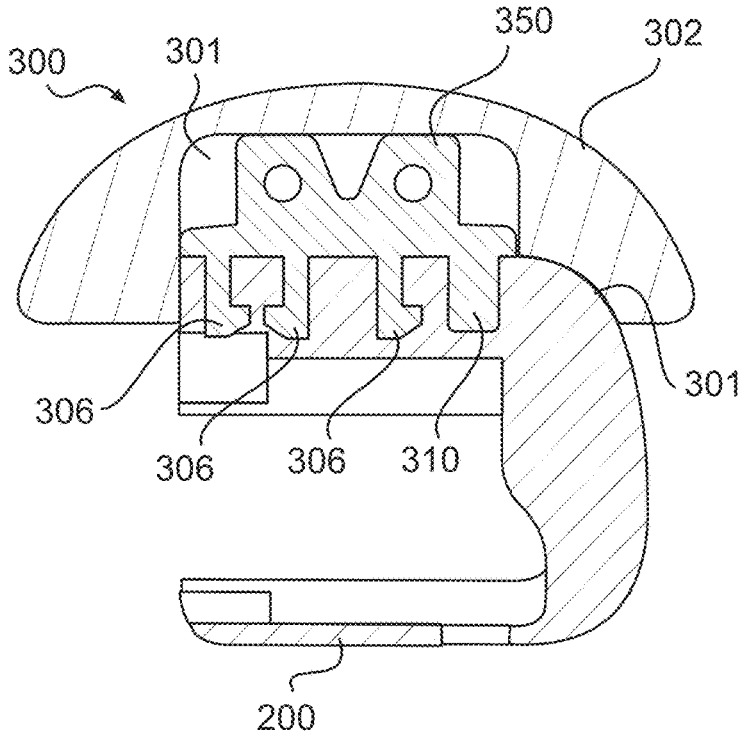
FIGS. 8A-8I depict aspects of slider assemblies according to exemplary embodiments hereof.

In some exemplary embodiments, a portion of the cavity 301 may also receive a portion of the mount 200 in addition to the base 304 and/or the base 304 combination. For example, FIG. 8A depicts a portion of the mount 200 configured within the cavity 301 of attachment 300 along with the base 304. Note that a separate attachment base support 311 may not be included in this configuration, and so the base 304 (which includes securing members 306) is directly connected to the attachment 300 (e.g., by glue or the like).

The securing members 306 may extend below the upper platform 305 of the base and into the cavity 301. The mount 200 may be partially received into the cavity 301 so that it may be configured with the securing members 306. Accordingly, the cavity 301 may be sized and shaped appropriately to receive at least a portion of the mount 200 as shown.

Figure 8B:
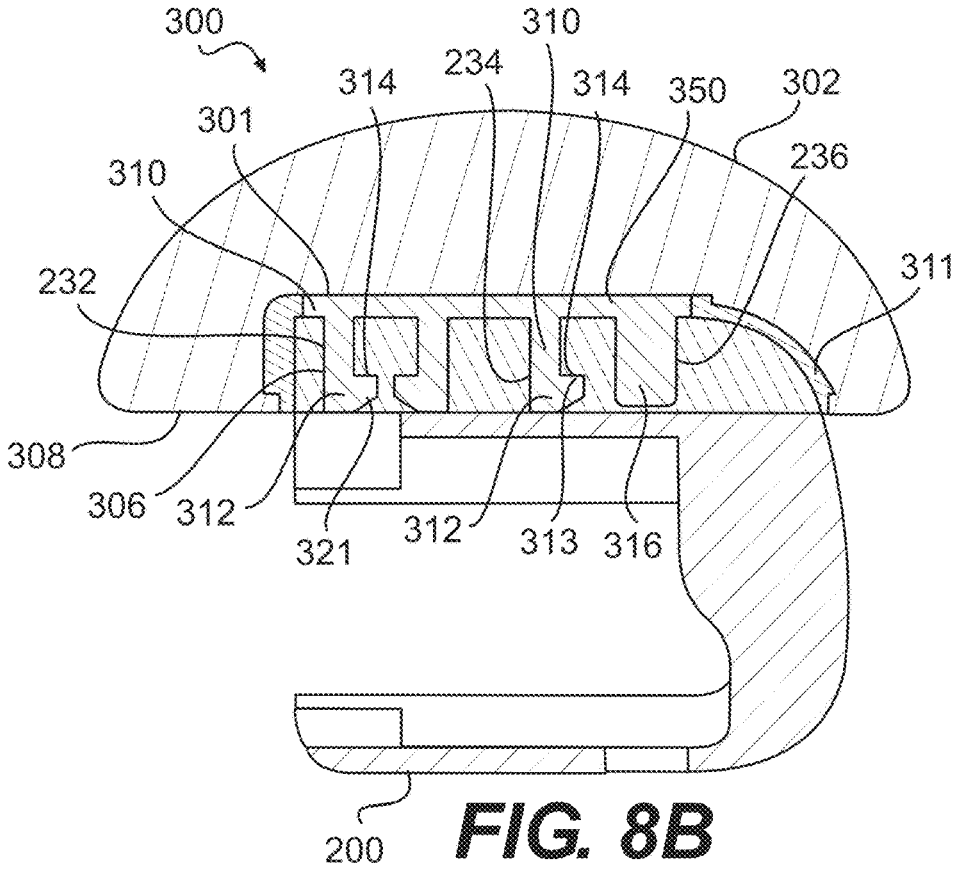
Figure 8C:
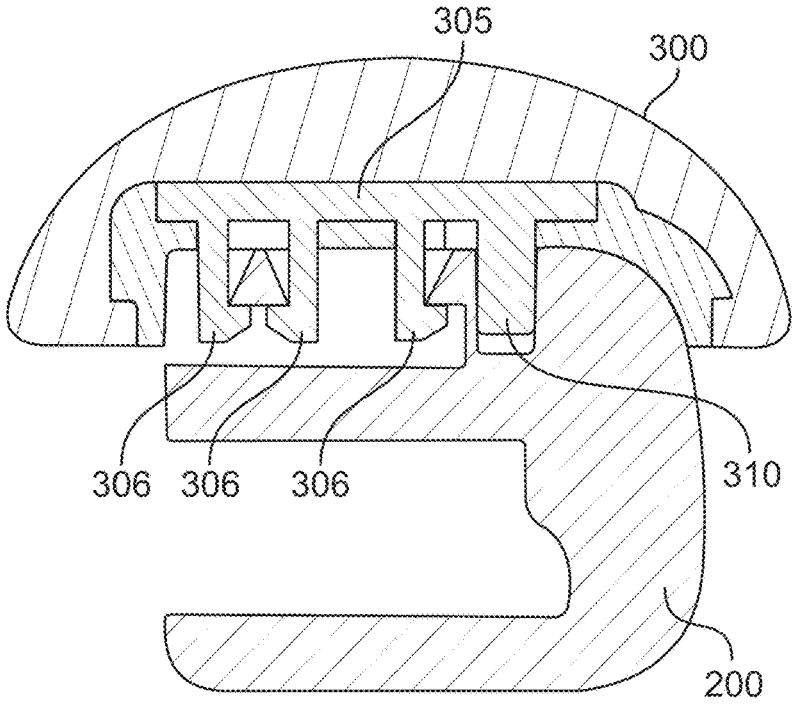
Figure 8D:
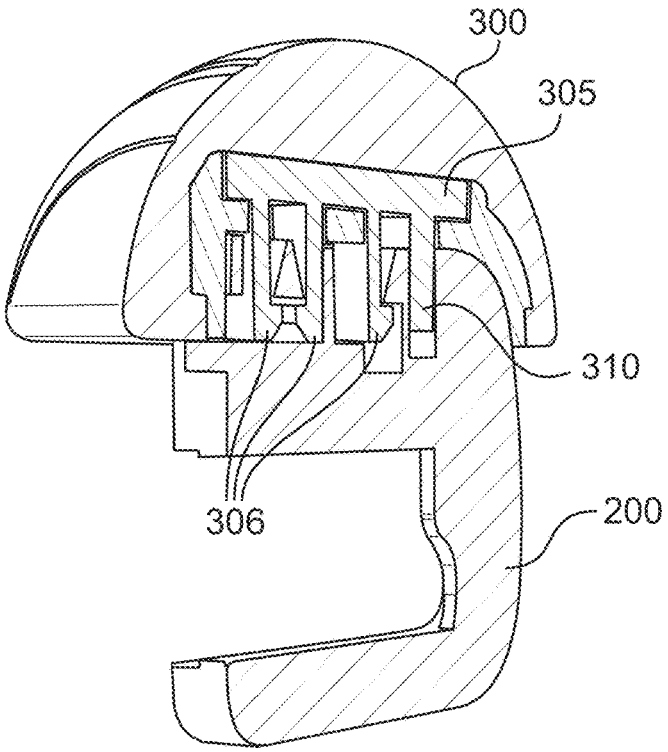
Figure 8E:
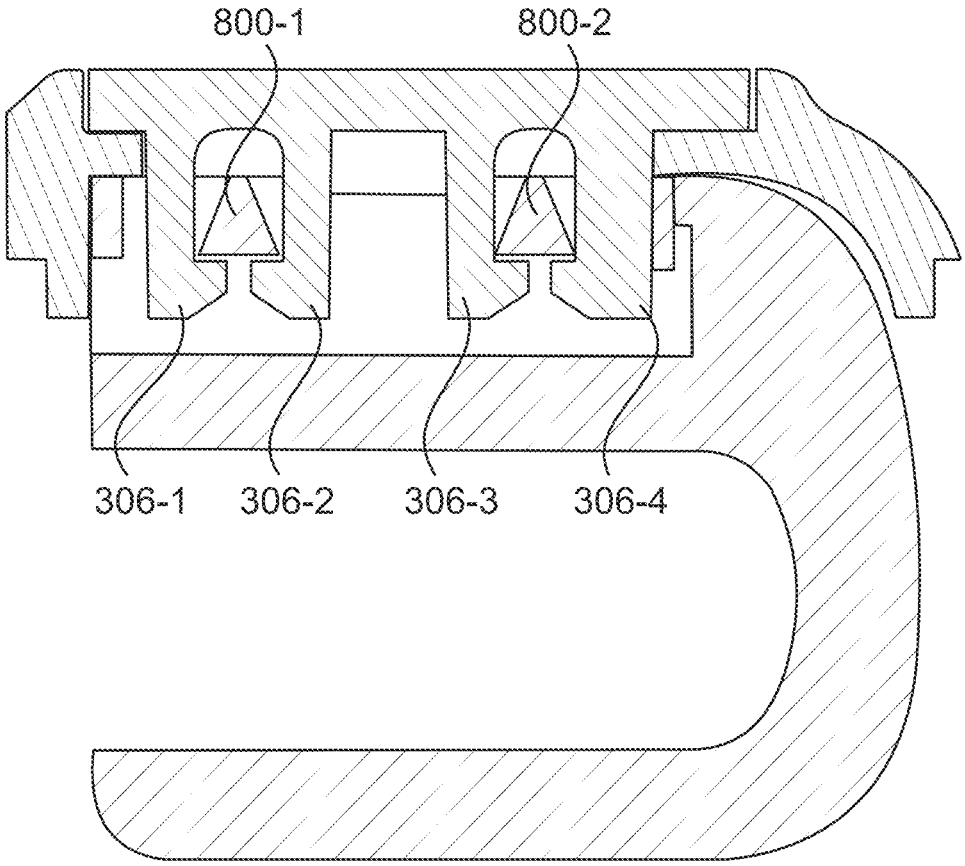

In other exemplary embodiments, e.g., as depicted in FIG. 8B, the mount 200 may be received, at least partially, into a portion of the cavity 301 that may be below the attachment base support 311 and base 304 combination. That is, the attachment base support 311 and base 304 combination may be generally configured in the upper area of the recess or cavity 301 and the mount 200 may be generally configured in the area of the recess or cavity 301 below (and possibly within) the attachment base support 311 and base 304 combination. Accordingly, the lower curvatures of the attachment base support 311 and the base 304 may be sized and shaped appropriately to receive a portion of the mount 200 as shown. It will be appreciated by a person of ordinary skill in the art upon reading this specification that the mount 200 may be configured with the attachment 300 with or without a portion of the mount 200 positioned within the cavity 301, and that the scope of the attachment 300 and the mount 200, alone or in combination, is not limited by the position of the mount 200 in relation to the attachment 300. For example, a portion of the mount 200 may not necessarily be received into the cavity 301 such that the mount 200 may instead be generally configured below the cavity 301.

In any event, it may be preferable in some exemplary embodiments that when the attachment body 302 and the base 304 are configured together or otherwise combined, that the securing members 306 may be available (e.g., may protrude) for configuring or generally attaching to the mount 200 as described.

As shown in FIG. 8B, securing members 306 may include one or more posts 310 and locking teeth 312. Locking teeth 312 may generally extend laterally from the lower portion of posts 310 and include top locking surfaces 321. It should be noted that not all posts 310 may be required to include locking teeth 312 and it is contemplated that is some exemplary embodiments, one or more posts 310 may not include locking teeth 312.

Figure 8F:
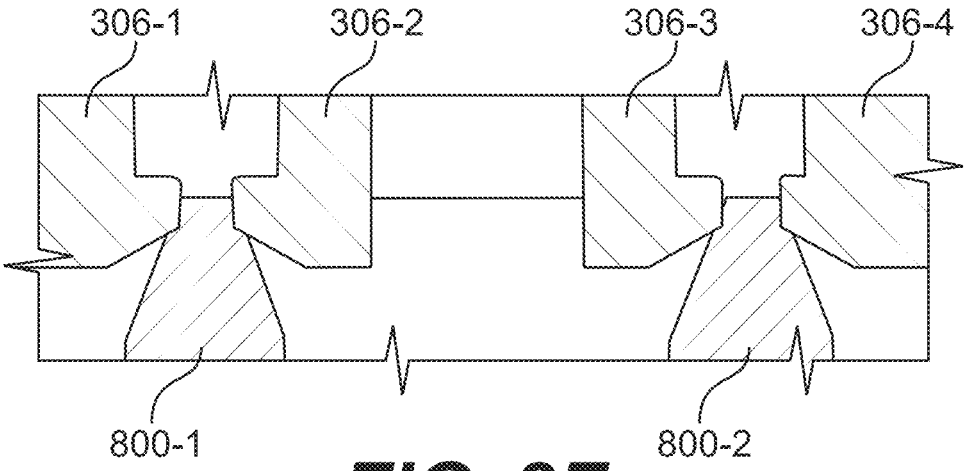
Figure 8G:
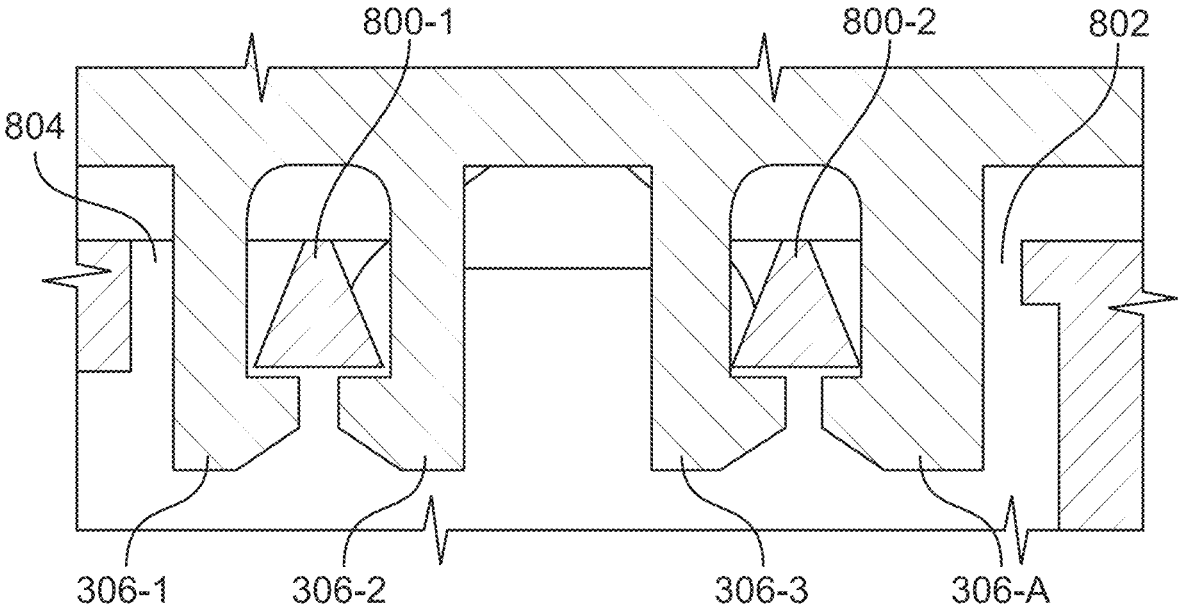
Figure 8H:
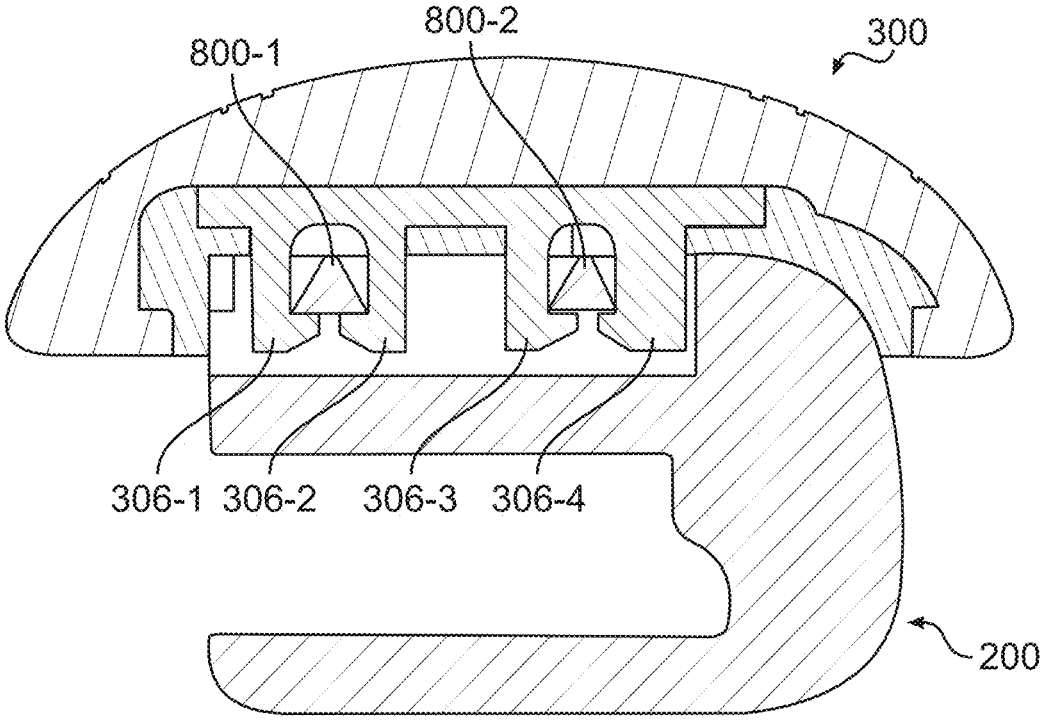
Figure 8I:
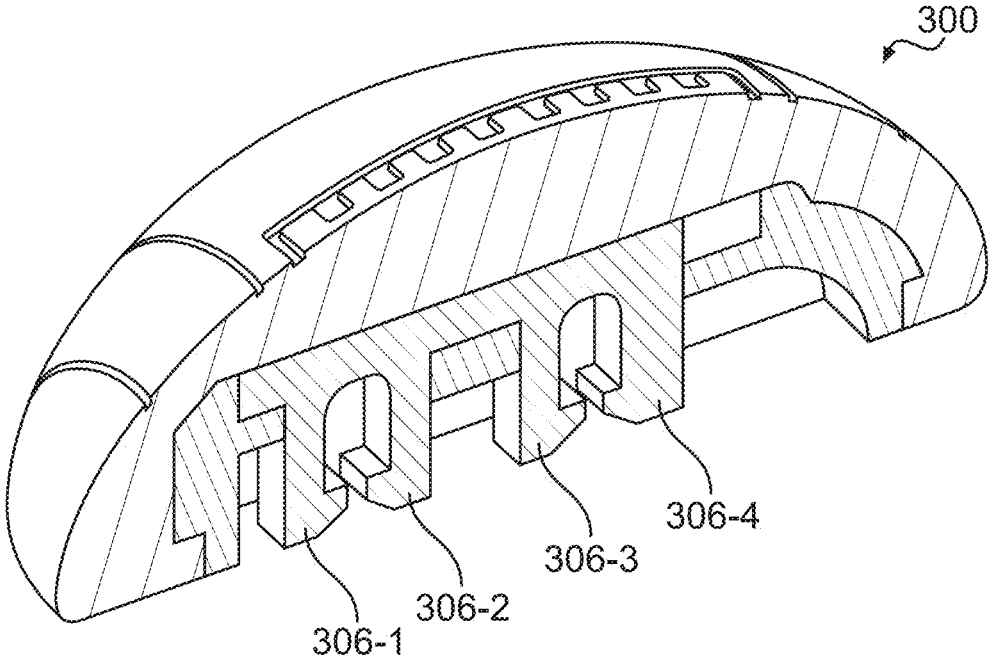

In some cases, e.g., as shown in FIGS. 8A-8D, three of the posts 310 have corresponding locking teeth 312, while a fourth post 316 does not have a locking tooth. In some other cases, e.g., as shown in FIGS. 8E-8I, four of securing members 306-1, 306-2, 306-3, 306-4 comprise posts each have a corresponding locking tooth. FIG. 8F shows the locking teeth on the posts on securing members 306-1, 306-2, 306-3, 306-4 prior to engaging and locking into position, as the securing members are inserted into the openings. FIG. 8G shows the locking teeth after the securing members have been positioned in place, with their respective locking teeth below the lower ridges of 800-1 and 800-2, respectively. As should be appreciated, the securing members (in this case, the posts with locking teeth), need to be sufficiently flexible to be inserted into the openings (FIG. 8F), and strong enough to withstand being pulled (with normal force) out of the openings after insertion. As shown, e.g., in FIG. 8G, there may be gaps (804 and 802) to allow room for the securing members during insertion.

The securing members need not all be the same size. For example, the securing member 306-4 may be wider than the other securing members (e.g., FIGS. 8E-8I).

With reference to the drawings in FIGS. 4B, 4D, 4E and 4G, mount 200 may, on its front side 205, include one or more outer openings (e.g., opening 232, opening 234, and opening 236). The outer openings 232, 234, 236 of the mount 200 may be configured to receive corresponding securing members 306 (and/or posts 310) of base 304. In various exemplary embodiments hereof, inner walls of the openings may taper or slope (e.g., inward or outward) to receive the securing members and/or posts (see, e.g., 800-1 and 800-2 in FIGS. 8E-8H, with sloped inner walls to allow for easier insertion of the securing members into the openings).

The openings of the mount 200 may also include lower ridges 314 (see, e.g., FIG. 8B) that may extend out laterally from the lower portion of the openings. In this way, using the example above, as securing members 306 (from a base 304) with locking teeth 312 are received into openings 232 and 234, locking teeth 312 may engage with lower ridges 314. The top surface of the locking teeth 312 may engage with the lower surface of the ridges 314 such that these respective surfaces may abut against each other, causing securing members 306 to be locked or otherwise secured within openings 232, 234.

Preferably the length of securing members 306 and/or posts 310 and the location of locking teeth 312 generally coincide with the depth of openings 232, 234 and the location of ridges 314, such that when securing members 306 and/or posts 310 are generally locked in openings 232, 234, there is minimal free vertical movement of the securing members 306 and/or posts 310. In this way, attachment body 302 and attachment base 304 may be securely attached to the front side 205 of mount 200.

It may also be preferable that openings 232, 234 have diameters that may allow securing members 306 and/or posts 310 (with or without locking teeth 312) to pass into openings 232, 234, as described above. For locking teeth 312 to pass through openings 232, 234 and lock with lower ridges 314, in some exemplary embodiments hereof, locking teeth 312 may need to slightly (sufficiently) compress as they pass through openings 232, 234 and then expand into the recesses under locking ridges 314 once they move past ridges 314.

In other exemplary embodiments, there may be a slight amount of lateral space within openings 232, 234, for example, behind securing members 306 and/or posts 310. In this way, as securing members 306 and/or posts 310 with locking teeth 312 are inserted into openings 232, 234, the securing members 306 and/or posts 310 may bend slightly backward into this extra lateral space as the securing members 306 and/or posts 310 are pushed into the openings 232, 234. This may allow securing members 306 and/or posts 310 with locking teeth 312 to pass through the openings 232, 234. Then, once locking teeth 312 pass ridges 314, securing members 306 and/or posts 310 may return to their unbent configuration and locking teeth 312 may move into the recess below lower ridges 314 to be locked in place as described above. In any event, once securing members 306 and/or posts 310 are received within holes/openings 232, 234 and locking teeth 312 are securely engaged with lower ridges 314, it may be preferable that there is minimal movement of securing members 306 and/or posts 310 within openings 232, 234 such that attachment body 302 and connected attachment base 304 may be securely attached to mount 200.

It should be noted that the examples above are meant for description purposes, and that different/other numbers and configurations of holes and securing members 306 and/or posts 310 may also be used and are contemplated herein. Furthermore, in some exemplary embodiments hereof, the openings may be configured to receive one or more securing members 306.

As noted, in some implementations, some posts 310 may not include locking teeth 312. In the example shown in FIGS. 8A and 8B, post 316 without locking teeth 312 may be received into a corresponding hole/opening 236 in the mount 200. In this case, opening 236 may not necessarily include lower ridge 314, and the post 310/opening 236 combination may generally provide lateral support to attachment body 302 and attachment base 304 configured with mount 200. When all posts 310 include a corresponding locking tooth 312, the openings are all sufficiently sized to allow the corresponding teeth 312 to pass there through. Furthermore, when all posts include a corresponding locking tooth, each opening preferably includes a corresponding lower ridge.

As described above, the mount 200 has openings to receive one or more corresponding posts and/or securing members. As should be appreciated, other configurations may also be used. For example, a mount may be configured with one or more posts and an attachment (or attachment base) may be configured with a corresponding one or more openings. Additionally, a combination approach may be used, where both the mount and the base each have one or more posts and/or securing members and each have a corresponding one or more openings. For example, in some exemplary embodiments hereof, mount 200 may include attachment securing members 306 instead of openings, and attachment 300 may include openings instead of attachment securing members 306. In addition, note that any combination thereof may also be used, such that, in some exemplary embodiments, both the mount 200 and the attachment 300 may include appropriately positioned openings and attachment members.

Attachment 300 may also be secured to mount 200 using other attachment mechanisms such as adhesive, screws, bolts, rivets, latches, locking pins, snaps, and other types of attachment mechanisms. In some exemplary embodiments hereof, attachment 300 may be configured with mount 200 before or after mount 200 is configured with slider 100.

It may be preferable for attachment 300 to also be removed (or removable) from mount 200 when desired. In one example, attachment 300 may be pulled away from mount 200 with enough force that may dislodge locking teeth 312 from ridges 314. It may be preferable that the amount of force required be not more than what a person of average strength may apply under normal use conditions, but enough to minimize any occurrences of the attachment 300 being removed unintentionally. As should be appreciated, removal of the attachment may break parts of the connection mechanism (e.g., the locking teeth).

In some exemplary embodiments hereof, it may be possible for attachment securing members 306 be pushed backwards within openings 232, 234 to disengage locking teeth 312 from ridges 314 for attachment 300 to be removed from mount 200.

Figure 9C:
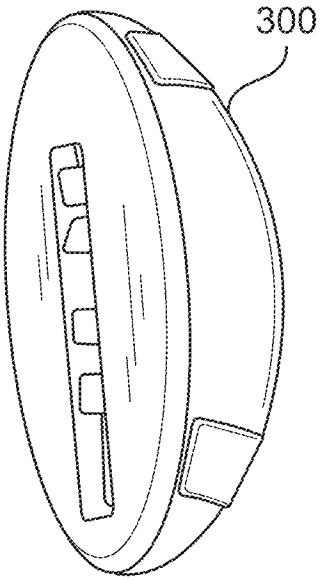
FIGS. 9A-9C depict the bottom, top and side of an attachment according to exemplary embodiments hereof.
Figure 9B:
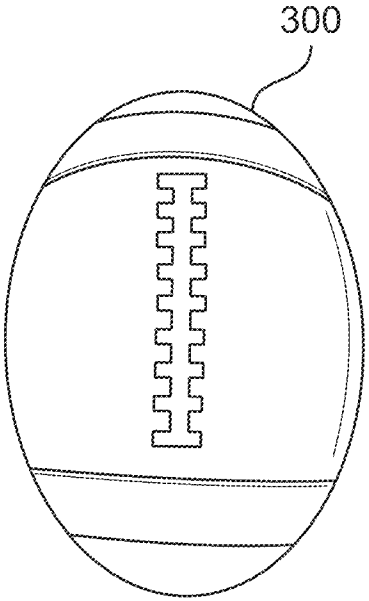
Figure 9A:
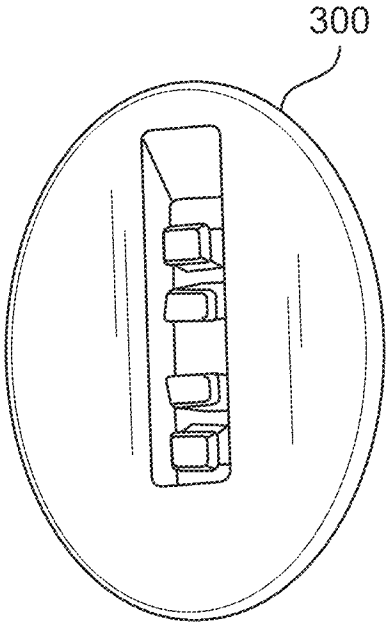
Figure 10A:
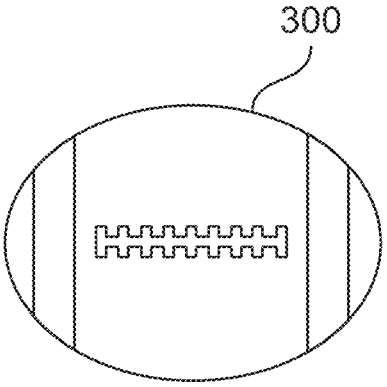
FIGS. 10A-10D are views of an attachment configured with a mount according to exemplary embodiments hereof.
Figure 10B:
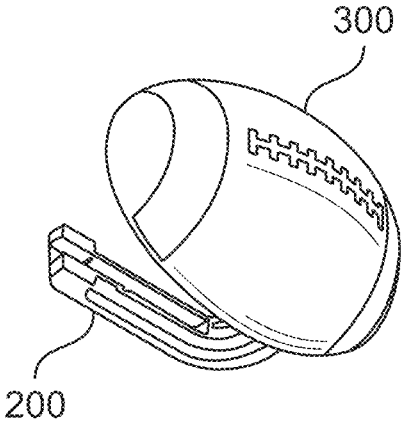
Figure 10C:
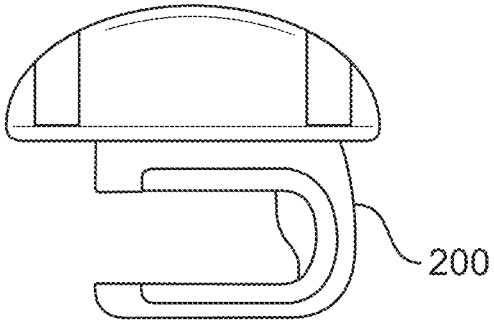
Figure 10D:
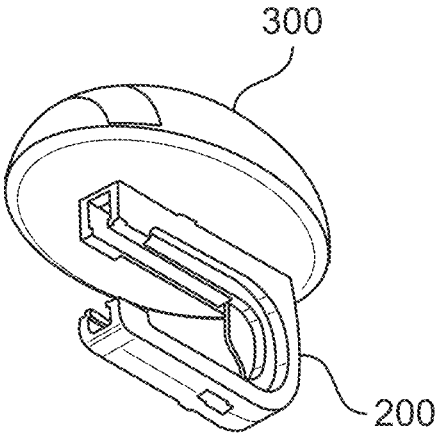
Figure 11A:
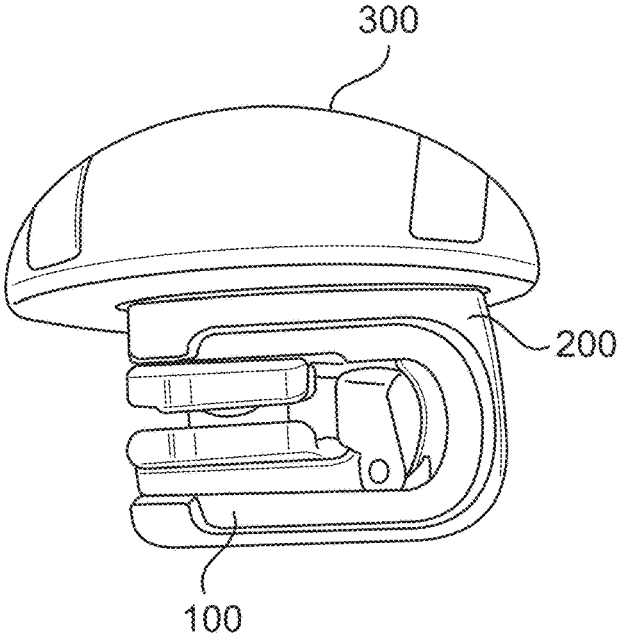
FIGS. 11A-11D depict views an attachment configured according to exemplary embodiments hereof.
Figure 11B:
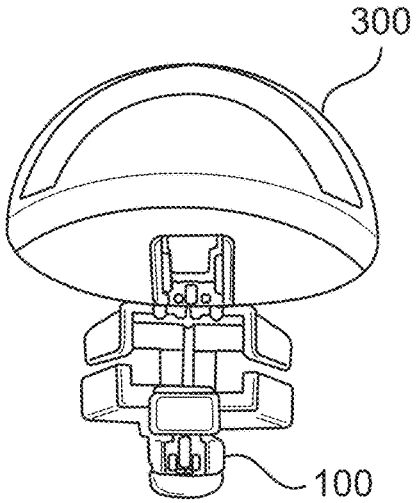
Figure 11C:
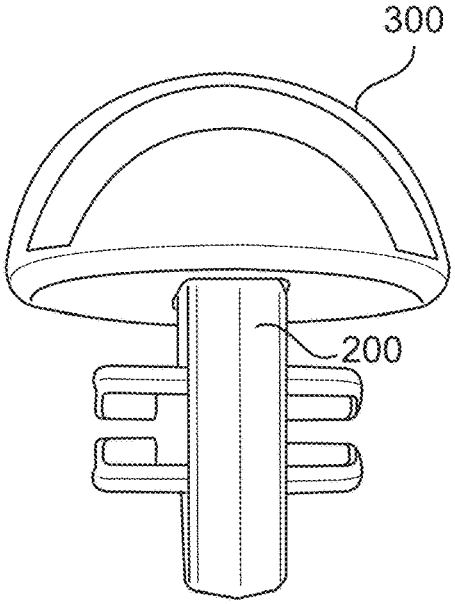
Figure 11D:
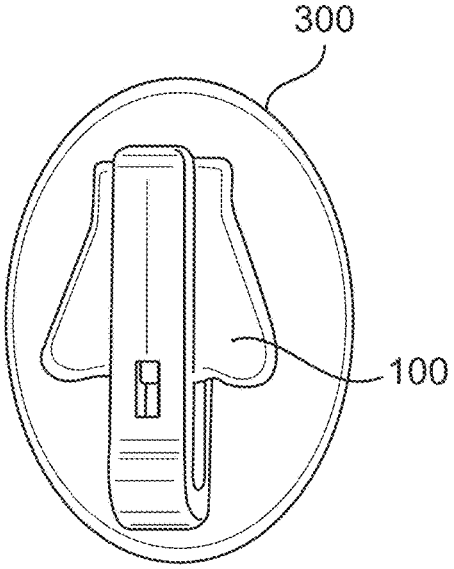

FIGS. 9A-9C depicts the bottom, top and side of an attachment according to exemplary embodiments hereof, and FIGS. 10A-10D show various views of an exemplary attachment 300 connected, e.g., as described above, to an exemplary mount 200.

The Components Together

As shown in FIG. 2, slider assembly 400 may be formed with attachment 300 secured to mount 200 and mount 200 secured with slider 100. While FIG. 2 depicts slider assembly 400 configured with a single row of zipper teeth, a second row of zipper teeth may be configured into the second channel within zipper assembly 10 to fasten the two rows of teeth together.

It may be preferable that the configuration of mount 200 and attachment 300 with slider 100 generally not interfere with the normal operation of slider assembly 100 with zipper chain 12. That is, it may be preferable that mount 200 and attachment 300 not interfere with left row of teeth 14 or the right row of teeth 18 as they pass through left and right channels 102, 106 and out mouth 38 of slider 100 to be interlocked to form zipper chain 12 or to be separated to individual left and right rows of teeth 14, 18.

Thus, as shown, slider assembly 400 may include slider 100, mount 200 and attachment 300. In general, slider 100 may be configured with a traditional zipper chain. Mount 200 may be securely configured with slider 100 and attachment 300 may in turn be securely configured with mount 200.

As described, the attachment 300, when attached to the mount 200, may take the place of or otherwise represent or function as a zipper puller. As such, the attachment 300 may be grasped by a user to move the slider 100 along the zipper chain 12 to open and/or close the zipper. Attachment 300 may replace a traditional puller or may be used in conjunction with a traditional puller. In some embodiments a traditional puller (e.g., a tab or loop) may connect to the attachment 300.

FIGS. 9A-9C depict the bottom, top and side of an attachment according to exemplary embodiments hereof. FIGS. 10A-10D are views of an attachment configured with a mount according to exemplary embodiments hereof; and FIGS. 11A-11D depict views an attachment configured according to exemplary embodiments hereof.

CONCLUSION

As used herein, including in the claims, the phrase "at least some" means "one or more," and includes the case of only one. Thus, e.g., the phrase "at least some ABCs" means "one or more ABCs", and includes the case of only one ABC.

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first" and "second" in the description and claims are used to distinguish or identify, and not to show a serial or numerical limitation. Similarly, the use of letter or numerical labels (such as "(a)", "(b)", and the like) are used to help distinguish and/or identify, and not to show any serial or numerical limitation or ordering.

Thus are provided a slider apparatus for a zipper and a zipper with such a slider apparatus.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

We claim:

1. An article of manufacture comprising a zipper assembly with a slider apparatus, the slider apparatus comprising:

a mount assembly configured and engaged with a slider assembly; and an attachment body attached to the mount assembly with an attachment base, wherein the attachment body is attached to the attachment base and wherein the attachment base is attached to the mount assembly, wherein the attachment base comprises a base support attached to the attachment body and a base connector engaged with and distinct from said base support, the base connector being attached to said mount assembly, wherein the base support and the base connector are comprised of distinct materials, and wherein the attachment base comprises three or more attachment members, and wherein the three or more attachment members engage with corresponding three or more holes in the mount assembly, wherein the three or more attachment members comprise three or more posts, at least some of the posts having corresponding locking teeth.

2. The article of manufacture of claim 1, wherein the base support is formed of a material comprising acrylonitrile butadiene styrene (ABS).

3. The article of manufacture of claim 1, wherein the base connector is formed of a material comprising a polycarbonate.

4. The article of manufacture of claim 3, wherein the article of manufacture is selected from: a garment, a bag, a shoe, an item of luggage, an item of sports equipment, a pencil case, a backpack, a computer case, a laptop case, luggage, a zip-up portfolio case, a zip-up storage bin, a sleeping bag, a tent, a makeup bag, a toiletry bag, a lunch bag, a hat with a zipper pocket, a toy, and toy clothing.

5. The article of manufacture of claim 1, wherein at least a portion of the attachment base is within a cavity of the attachment body.

6. The article of manufacture of claim 1, wherein the mount assembly comprises an inner opening, and wherein the slider assembly is configured within the inner opening.

7. The article of manufacture of claim 1, wherein the one or more attachment members are configured within at least one opening in the mount assembly.

8. The article of manufacture of claim 1, wherein the three or more posts consist of four posts, at least three of the four posts having a corresponding locking tooth.

9. The article of manufacture of claim 1, wherein the three or more of the posts are in a row.

10. The article of manufacture of claim 1, wherein the posts are substantially aligned along a center portion of the attachment base.

11. The article of manufacture of claim 1, wherein the three or more posts comprise a first post, a second, a third post, and a fourth post, and wherein the first post has a first locking tooth of said corresponding locking teeth; and the second post has a second locking tooth of said corresponding locking teeth; and the third post has a third locking tooth of said corresponding locking teeth; and the fourth post has a fourth locking tooth of said corresponding locking teeth, and wherein the first locking tooth faces the second locking tooth, and the third locking tooth faces the fourth locking tooth.

12. The article of manufacture of claim 11, wherein the mount assembly comprises a first engagement portion having a first lower ridge and a second engagement portion, distinct from the first engagement portion and having a second lower ridge, and wherein the first locking tooth and the second locking tooth are positioned below the first lower ridge, and the third locking tooth and the fourth locking tooth are positioned below the second lower ridge.

13. The article of manufacture of claim 1, wherein one of the attachment members is wider than at least one other of the attachment members.

* * * * *